US008033420B2

(12) United States Patent
Roseblade et al.

(10) Patent No.: US 8,033,420 B2
(45) Date of Patent: Oct. 11, 2011

(54) ANTI-SPLASH DEVICE FOR A BEVERAGE CONTAINER

(75) Inventors: Dan Roseblade, Cypress, CA (US); Richard Anderson, Westminister, CA (US)

(73) Assignee: HTSS Capital LLC, Round Rock, TX (US)

( * ) Notice: Subject to any disclaimer, the term of this patent is extended or adjusted under 35 U.S.C. 154(b) by 70 days.

(21) Appl. No.: 11/946,741

(22) Filed: Nov. 28, 2007

(65) Prior Publication Data

US 2008/0156817 A1 Jul. 3, 2008

Related U.S. Application Data

(60) Provisional application No. 60/861,508, filed on Nov. 28, 2006, provisional application No. 60/916,266, filed on May 4, 2007.

(51) Int. Cl.
*B65D 43/04* (2006.01)
*A47G 19/22* (2006.01)

(52) U.S. Cl. ..... 220/731; 220/369; 220/713; 220/719; 99/297

(58) Field of Classification Search ..... 119/61.54, 119/61.55; 220/369–372, 563, 578, 580, 220/704, 713, 719, 731; 99/297
See application file for complete search history.

(56) References Cited

U.S. PATENT DOCUMENTS 586,833 A * 7/1897 Brown ..... 210/464
852,472 A 5/1907 Tacey
1,098,653 A 6/1914 Whisenant
1,137,462 A 4/1915 Clark
1,254,251 A 1/1918 Magnus
1,739,627 A 12/1929 Austin
1,831,527 A * 11/1931 Dovidaitis ..... 210/265
1,978,025 A 10/1934 McCown
2,167,619 A * 8/1939 Bainton ..... 220/578
2,190,203 A * 2/1940 Barnard ..... 220/578

(Continued)

FOREIGN PATENT DOCUMENTS

GB 841101 7/1960

(Continued)

OTHER PUBLICATIONS

International Search Report for International Application No. PCT/US2007/85798 mailed Jun. 5, 2008. Application No. PCT/US2007/85798 claims priority to the same provisional applications as U.S. Appl. No. 11/946,741.

*Primary Examiner* — J. Gregory Pickett
*Assistant Examiner* — Ned A Walker
(74) *Attorney, Agent, or Firm* — Knobbe, Martens, Olson & Bear, LLP

(57) ABSTRACT

An anti-splash device for use in a cup or other container can help prevent or minimize sloshing, splashing and other undesirable movement of fluids. In some embodiments, the device includes a main body portion having a plurality of openings. The device can also include one or more features that are configured to engage an interior wall of the cup or other container. In other embodiments, the anti-splash device can attach to the brim of a cup or to a lid. In other embodiments, an anti-splash device, a cup lid or any other components related to a beverage or food container comprises one or more finger guides that provide targeted points of contact when manipulating such a device.

18 Claims, 35 Drawing Sheets

U.S. PATENT DOCUMENTS 2,211,486 A * 8/1940 Zoia ..... 99/287
2,357,063 A 5/1942 Swing
2,313,845 A * 3/1943 Sundholm ..... 222/387
2,358,600 A 9/1944 Selten
2,529,114 A * 11/1950 Tellier ..... 220/713
2,744,631 A * 5/1956 Toombs ..... 210/469
2,761,301 A 9/1956 Tellier
2,787,897 A 4/1957 Taylor
2,828,886 A 4/1958 Thomas
2,900,896 A * 8/1959 Bondanini ..... 99/287
D188,730 S * 8/1960 Berman ..... D7/667
3,040,897 A 6/1962 Holman
3,137,228 A * 6/1964 Elow ..... 99/287
3,164,289 A * 1/1965 Cocchiarella ..... 220/578
3,184,126 A * 5/1965 Casull ..... 222/487
D205,595 S 8/1966 Titus
3,268,198 A 8/1966 Swett
3,273,608 A * 9/1966 Frankenberg ..... 141/27
3,273,741 A 9/1966 Faunce
3,307,474 A * 3/1967 Kasher ..... 99/287
3,313,447 A 4/1967 Spencer
3,319,842 A 5/1967 Miller
3,360,160 A 12/1967 Spencer
3,360,161 A 12/1967 Smith
3,379,338 A 4/1968 Marks et al.
3,443,584 A 5/1969 Evensen et al.
3,543,287 A * 11/1970 Henkel ..... 220/698
3,549,044 A 12/1970 Lerner
3,727,808 A * 4/1973 Fitzgerald ..... 222/482
3,730,399 A 5/1973 Dibrell et al.
3,762,591 A 10/1973 Gray
D229,007 S 11/1973 Hodges
3,783,555 A * 1/1974 Peters ..... 47/79
3,915,331 A * 10/1975 Chenault ..... 220/711
3,940,012 A 2/1976 Addington
3,987,941 A * 10/1976 Blessing ..... 222/386
3,995,544 A * 12/1976 Farley ..... 100/116
4,023,305 A 5/1977 Harschel
D245,384 S 8/1977 Ashton
D246,026 S 10/1977 Stahel
4,130,215 A 12/1978 Corey et al.
4,157,707 A * 6/1979 Schwind et al. ..... 126/386.1
4,169,671 A 10/1979 Culler
4,183,175 A * 1/1980 Magee ..... 47/79
D258,485 S 3/1981 Eller
4,312,459 A 1/1982 Leach
4,331,255 A 5/1982 Fournier
4,366,914 A * 1/1983 Ingram ..... 220/287
4,416,387 A 11/1983 D'Antonio
4,446,986 A * 5/1984 Bowen et al. ..... 220/789
4,478,346 A * 10/1984 Spong ..... 220/711
4,509,412 A * 4/1985 Whittenburg et al. ..... 99/331
4,625,883 A 12/1986 Burke et al.
4,650,583 A * 3/1987 Bondanini ..... 210/474
4,682,705 A 7/1987 Hurwitz
4,723,674 A * 2/1988 Nunes ..... 215/231
4,731,177 A * 3/1988 Hemman ..... 210/86
D297,297 S 8/1988 Lacey
4,768,674 A 9/1988 Prescott
4,802,302 A 2/1989 Alnafissa
4,842,157 A 6/1989 Stone-Parker et al.
4,858,872 A 8/1989 Witt
4,938,375 A 7/1990 Fantacone
4,938,377 A * 7/1990 Jarvis ..... 220/216
D317,570 S * 6/1991 Kryk ..... D9/434
5,033,453 A * 7/1991 Loyd et al. ..... 126/377.1
5,148,951 A * 9/1992 Moure et al. ..... 222/386
5,150,816 A * 9/1992 DeCastro ..... 220/711
D330,310 S 10/1992 Montgomery
5,153,977 A 10/1992 Toida et al.
D332,030 S 12/1992 Kauffman et al.
5,168,140 A * 12/1992 Welker ..... 219/689
5,213,230 A * 5/1993 Kral ..... 220/580
5,249,703 A * 10/1993 Karp ..... 220/719
5,289,938 A * 3/1994 Sanchez ..... 220/789
5,339,981 A * 8/1994 Kral ..... 220/580
D353,298 S * 12/1994 Hartpence et al. ..... D7/400
5,370,258 A 12/1994 Fair
5,377,621 A * 1/1995 Camm ..... 119/61.54
5,395,006 A * 3/1995 Verma ..... 220/371
5,402,908 A * 4/1995 Warden et al. ..... 220/554
D361,697 S * 8/1995 McNaughton ..... D7/667
5,461,968 A 10/1995 Portman
5,540,350 A 7/1996 Lansky
5,573,140 A 11/1996 Satomi et al.
5,588,197 A 12/1996 Satomi et al.
5,601,199 A 2/1997 Marty
5,618,570 A * 4/1997 Banks et al. ..... 426/435
5,678,684 A * 10/1997 Wright ..... 206/204
5,704,510 A * 1/1998 Feltman et al. ..... 220/293
5,727,347 A * 3/1998 Sellers ..... 47/67
5,727,712 A 3/1998 Cotello
5,775,205 A * 7/1998 Melton ..... 99/322
5,780,087 A * 7/1998 Brady ..... 426/474
D400,397 S 11/1998 Stephan
5,839,598 A * 11/1998 Mitchell ..... 220/321
5,860,558 A 1/1999 Fahy
D407,944 S * 4/1999 Filbrun ..... D7/396.2
D408,227 S 4/1999 Swann, Jr.
5,913,964 A * 6/1999 Melton ..... 99/322
5,939,122 A * 8/1999 Brady ..... 426/474
5,971,202 A 10/1999 Filbrun
5,979,689 A * 11/1999 Lansky ..... 220/255
5,993,096 A 11/1999 Martelli
D421,555 S * 3/2000 Duhamel ..... D7/667
6,036,038 A * 3/2000 Lovelace et al. ..... 215/391
6,076,450 A * 6/2000 DiGiorgio, Jr. ..... 99/298
6,095,033 A * 8/2000 Melton ..... 99/323.3
6,199,711 B1 3/2001 Lansky
6,202,877 B1 * 3/2001 La Torre et al. ..... 220/254.1
6,263,781 B1 * 7/2001 Calagui ..... 99/323
6,283,627 B1 9/2001 Fromm
6,305,571 B1 10/2001 Chu
6,314,866 B1 * 11/2001 Melton ..... 99/322
6,318,584 B1 * 11/2001 Milan ..... 220/713
6,324,967 B1 12/2001 Robinson
6,374,726 B1 4/2002 Melton
6,578,726 B1 * 6/2003 Schaefer ..... 220/253
6,588,622 B1 7/2003 Leishman et al.
D477,968 S * 8/2003 Bin ..... D7/510
D485,136 S * 1/2004 Golden et al. ..... D7/667
6,702,145 B2 3/2004 Malcolm
6,725,763 B2 4/2004 Cai
6,797,304 B2 * 9/2004 McGonagle ..... 426/431
7,000,347 B2 * 2/2006 Roskin ..... 47/41.11
7,017,768 B2 3/2006 Iskierka
7,040,218 B1 5/2006 Biolchini, Jr.
7,093,531 B2 8/2006 Tardif
7,100,790 B2 * 9/2006 Dark ..... 220/711
7,163,113 B2 * 1/2007 Manganiello et al. ..... 215/11.5
D538,981 S * 3/2007 Skowronski ..... D30/132
7,213,507 B2 * 5/2007 Glucksman et al. ..... 99/297
D572,416 S 7/2008 Dye, Jr.
7,461,587 B2 * 12/2008 Guerrero ..... 99/323
7,597,213 B2 * 10/2009 McDonald ..... 221/46
7,673,555 B2 3/2010 Nosler et al.
2004/0068931 A1 * 4/2004 Lai ..... 47/80
2004/0232154 A1 11/2004 Smith et al.
2006/0169603 A1 * 8/2006 Lancesseur et al. ..... 206/204
2006/0249521 A1 11/2006 Dark
2007/0240580 A1 * 10/2007 Lusareta et al. ..... 99/279

FOREIGN PATENT DOCUMENTS

GB 2351010 12/2000
JP 2281193 11/1990
JP 2003237811 8/2003

* cited by examiner

ANTI-SPLASH DEVICE FOR A BEVERAGE CONTAINER

CROSS-REFERENCE TO RELATED APPLICATIONS

This application claims the priority benefit under 35 U.S.C. §119(e) of U.S. Provisional Application No. 60/861,508, filed Nov. 28, 2006, and U.S. Provisional Application No. 60/916,266, filed May 4, 2007, the entirety of which are hereby incorporated by reference herein.

BACKGROUND

1. Field of the Invention

This application relates in general to barrier members for containers, and in particular to anti-splash devices and lids incorporating same for cups and other beverage containers.

2. Description of the Related Art

Different types of lids for cups are known in the beverage container industry. Further, various types of lids exist for disposable cups or other containers (e.g., paper coffee cups, polystyrene, plastic or paper soft drink cups, etc.). Typically, such lids engage an upper rim of a cup to prevent the spillage of liquid or other substances contained within the cup. Some lids include an opening which is configured to provide access to the interior of the cup. However, a need exists for a device that minimizes sloshing, splashing and other undesirable movement of a liquid contained within a cup.

SUMMARY OF THE INVENTION

According to some embodiments of the present application, an anti-splash device configured for placement within a beverage container includes a main body portion comprising a plurality of openings, the openings configured to permit the passage of fluids therethrough and an outer peripheral edge extending outwardly from the main body portion, the outer peripheral edge being configured to contact an interior wall of the container so as to generally maintain the position of the anti-splash device relative to the container. In some embodiments, the main body portion is configured to be located at or below a brim of the container when situated therein.

According to other embodiments, a lid for a beverage container includes a cover member and an anti-splash device comprising a plurality of openings and a peripheral edge, the peripheral edge being configured to at least partially engage the interior portion of the cover member. The cover member comprises an outer flange configured to engage an upper brim of the container, an interior portion configured to be generally parallel with a wall of a container when the lid is positioned on the container and at least one sipping hole.

In some embodiments, a method of reducing undesirable spills out of a beverage container includes providing an anti-splash device having a plurality of openings and an outer peripheral edge configured to snugly engage an internal wall of the container, positioning the anti-splash device within an interior portion of the beverage container and moving the anti-splash device downwardly to a position at or below a brim of the container so that the outer peripheral edge snugly engages an internal wall of the container, at least a portion of the outer peripheral edge being configured to contact and substantially match the shape of an internal wall of the container.

An anti-splash device can be advantageously positioned between the top surface of a beverage (or other liquid) contained within a cup and the location at which a user can access the interior of that cup (e.g., sipping hole, other opening, top rim of the cup, etc.). In some embodiments, such an anti-splash device may prevent undesirable splashing or other movement of the beverage or other liquid. Further, the anti-splash device can help insulate the beverage.

In some embodiments, an anti-splash device configured for placement in a cup includes a main body portion or interface member configured to be retained between the top surface of a liquid within a cup and the top of the cup from which a user consumes the liquid. The main body portion or interface member includes a plurality of openings through which air, liquid or other fluids may pass.

In one embodiment, an anti-splash device configured for placement in a cup includes a main body portion (e.g., flat portion) configured to be retained substantially parallel with a liquid surface of a beverage contained within a cup and a plurality of openings positioned on the main body portion. The main body portion is preferably located at or below a brim of a cup. As used herein, the term "flat" is a broad term and may include, without limitation, planar, non-planar, curved (e.g., convex, concave), domed, spherical, conical, fluted, wavy, curled, grooved, channeled, irregular-shaped and/or the like.

In one embodiment, the main body portion comprises a substantially circular shape. In another embodiment, at least one of the openings in the main body portion has a substantially circular shape. In other embodiments, the main body portion further includes a flexible outer section which is configured to engage an interior wall of a cup or lid so as to maintain the position of the main body portion relative to the cup.

In one embodiment, the anti-splash device additionally includes an outer wall portion which is attached to the main body portion and is configured to engage an interior wall of a cup or lid. In other embodiments, the anti-splash device also includes a hook element which is configured to engage at least a portion of a brim of a cup or a lid.

In one embodiment, at least a portion of the anti-splash device is disposable. In other embodiments, at least a portion of the anti-splash device is reusable. In some embodiments, the main body portion of the device includes a plastic material. In still other embodiments, the main body portion of the anti-splash device comprises a paper material.

In one embodiment, the anti-splash device is formed as a unitary member with a cup. In other embodiments, the anti-splash device includes polystyrene. In another embodiment, the main body portion of the device is configured to insulate a liquid contained within a cup when the anti-splash device is positioned within the cup.

In one embodiment, a lid for a beverage container includes a cover portion. The cover portion includes an outer flange configured to engage an upper brim of a cup, an interior cylindrical wall configured to be substantially parallel with a wall of a cup when the lid is positioned on the cup and at least one sipping hole. The lid additionally includes an anti-splash portion which comprises a main body portion and an outer wall portion. The anti-splash portion includes a plurality of openings. The outer wall portion is attached to the main body portion and is configured to engage the interior cylindrical wall of the cover portion.

In some embodiments, the cover portion and the anti-splash portion are a unitary member. In other embodiments, the cover portion and the anti-splash portion are separate members. In one embodiment, the cover portion and the anti-splash portion are configured to be held together by friction. In yet another embodiment, at least a portion of the lid is disposable.

In some embodiments, a lid, anti-splash device or any other component or accessory related to a beverage or food container comprises one or more finger guides or other contact points. In some embodiments, such finger guides or contact points provide targeted points of contacts for exerting a pushing, pulling and/or any other type of force or moment thereon. The finger guides or contact points can be structurally reinforced to accommodate relatively higher forces, moments and/or stresses than one or more surrounding areas. In addition, such finger guides provide hygienic advantages, as a user is encouraged or directed to only contact the lid, anti-splash device or other components having the finger guides at certain strategically positioned locations.

In some embodiments, an anti-splash device which is configured for placement in a cup or lid comprises a main body portion and a plurality of openings positioned on the main body portion. The main body portion includes one or more finger guides which provide a targeted contact point when manipulating the device. In some embodiments, the anti-splash device comprises one, two, three or more finger guides.

In other embodiments, a lid which is configured to mate with an upper brim portion of a beverage container comprises a lower flange configured to secure to a brim portion of a beverage container and an upper surface. The upper surface comprises at least one finger guide which provides a targeted contact point when positioning the lid relative to a beverage container. In some embodiments, the lid comprises one, two, three or more finger guides.

BRIEF DESCRIPTION OF DRAWINGS

These and other features, aspects and advantages of the present specification are described with reference to drawings of certain preferred embodiments, which are intended to illustrate, but not to limit, the disclosure herein. The drawings include sixty (60) figures. It is to be understood that the attached drawings are for the purpose of illustrating concepts and may not be to scale.

DETAILED DESCRIPTION

The discussion below and the figures referenced herein describe various embodiments of an anti-splash device and methods for preventing unwanted sloshing, splashing and spillage of liquids or other materials placed within container. A number of these embodiments are particularly well suited for implementation in a disposable cup, travel mug and the like. However, it will be appreciated that the features, advantages and other characteristics related to the different embodiments described herein may be incorporated into other types of containers and storage devices, whether intended to retain a beverage or not.

An anti-splash device can be positioned within a cup or another container and/or within a lid or other component of a beverage container to eliminate or reduce splashing, sloshing and/or other undesirable movements of the beverage or other materials. In some embodiments, such devices can also help insulate a beverage (hot or cold), while simultaneously permitting normal flow of the beverage into and/or out of the cup or other container. As discussed in greater detail herein, the insulating properties of such devices can be enhanced through a plurality of specially-oriented openings. According to some arrangements, the size and shape of the openings in an anti-splash device can help promote the bonding of fluid across the holes or other openings of the device. This can help create additional thermal barriers against the escape and exchange of fluids (e.g., hot beverages, vapor, warm air, ambient air, etc.) across the anti-splash device. Such anti-splash devices can also be configured to provide structural support to the cup or other container into which the device is placed. In addition, these anti-splash devices can help seal the seam of a paper cup or other container.

Figure 1A:
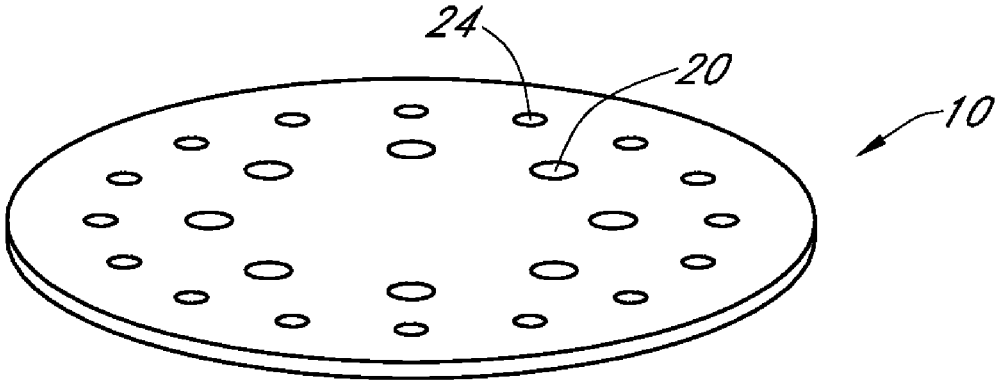
FIG. 1A is a perspective view of an circular anti-splash device in accordance with one embodiment.

With reference to FIG. 1A, an anti-splash device 10 can include a plurality of openings 20, 24. As shown, the anti-splash device 10 can have a generally circular shape. Alternatively, the anti-splash device 10 may have any other shape, such as, for example, polygonal (e.g., triangular, square, rectangular, etc.), oval, elliptical or the like.

In addition, the shape of the anti-splash device 10 can be generally planar and/or non-planar shape, such as, for example, convex, concave, domed, spherical, conical, fluted, wavy, curled, grooved, channeled, irregular-shaped and/or the like.

In one embodiment, the diameter or other comparable dimension (e.g., length, width, etc.) of the anti-splash device 10 can be approximately 3¼ inches. However, the diameter or other dimension of the anti-splash device 10 can be larger or smaller than 3¼ inches, as desired or required for a particular application or use. Further, as shown in the embodiment of FIG. 1A, the anti-splash device 10 can have a relatively small thickness as compared to its diameter. For example, the thickness of the anti-splash device 10 can be 0.01 inches, 0.02 inches, 0.04 inches, 0.1 inches, 0.2 inches or thicknesses between such values. In other embodiments, the thickness of the anti-splash device can be smaller than 0.01 or greater than 0.2 inches.

The shape, size, orientation, positioning, spacing and/or other features of the openings of the anti-splash device 10 can vary. For example, each of the embodiments of the anti-splash device 10 illustrated in FIGS. 1A and 1B includes a row of generally circular openings 20 having a first diameter. In the depicted embodiments, the openings 20 are generally evenly distributed along a circular row located at a particular radius relative to the center of the device (represented by line 22). In some arrangements, the anti-splash device 10 comprises eight evenly-spaced 3/16-inch diameter openings 20 which are positioned approximately 0.8 inches from the center of the device 10.

Figure 1B:
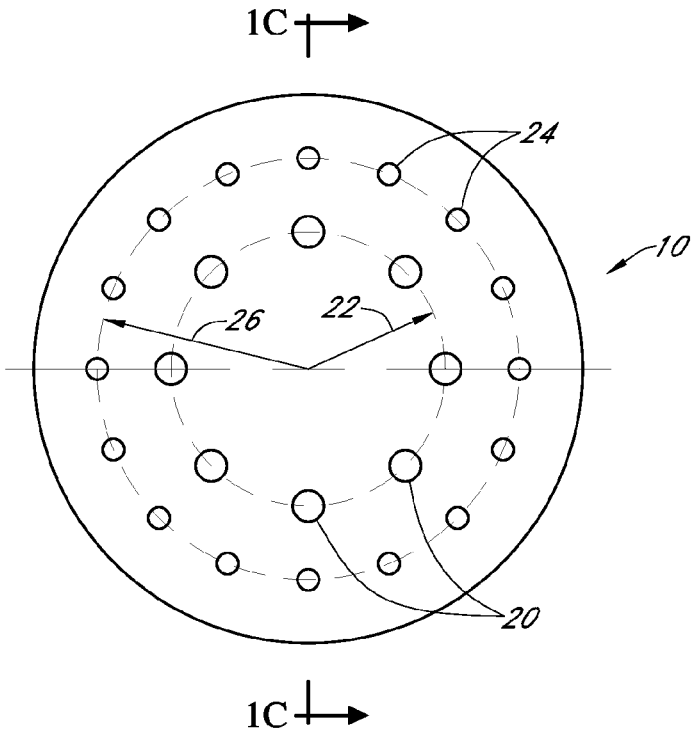
FIG. 1B is a top view of the anti-splash device of FIG. 1A.

With continued reference to FIG. 1B, the anti-splash device 10 can include additional openings 24 positioned along a different concentric circular row. In the illustrated embodiment, these additional openings 24 are positioned closer to the periphery of the anti-splash device 10, along a longer radius from the center of the device 10 (represented by line 26). As shown, the additional openings 24 can have a smaller diameter and a different spacing relative to each other. In one embodiment, the anti-splash device 10 comprises sixteen evenly-spaced ⅛-inch diameter openings 24 which are positioned approximately 1.25 inches from the center of the device 10. However, it will be appreciated that the quantity, diameter, spacing, orientation, shape and/or other characteristics of the openings 20, 24 of an anti-splash device 10 can be different than illustrated and discussed herein.

Figure 1C:
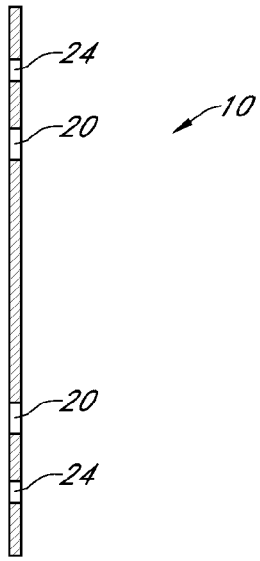
FIG. 1C is a cross-sectional view of the anti-splash device of FIG. 1A.

As discussed, the anti-splash device 10 can include more or fewer openings than illustrated in the embodiments of FIGS. 1A through 1C. In addition, the shape, size, spacing, orientation and general configuration of the openings can vary. The design details related to the openings can depend on one or more factors, such as, for example, the type, size, shape, dimensions and other properties of the anti-splash device, the size, shape, dimensions and other properties of the cup or other container into which the anti-splash device may be placed, the type, density, viscosity, temperature range and other properties of the beverage with which the anti-splash device may come into contact, the desired flow rate of fluids (e.g., air, beverage, etc.) through the openings during use, the desired location(s) of the cup that the anti-splash device will contact and/or the like. A device 10 can include openings having more than one shape and/or size. Further, the pattern of openings disposed on a particular anti-splash device 10 may be random instead of regular (e.g., along a particular circle) as illustrated herein. Variations in the shape, size, spacing, randomness and other details regarding the openings are applicable to any embodiments of an anti-splash device discussed herein.

Figure 2:
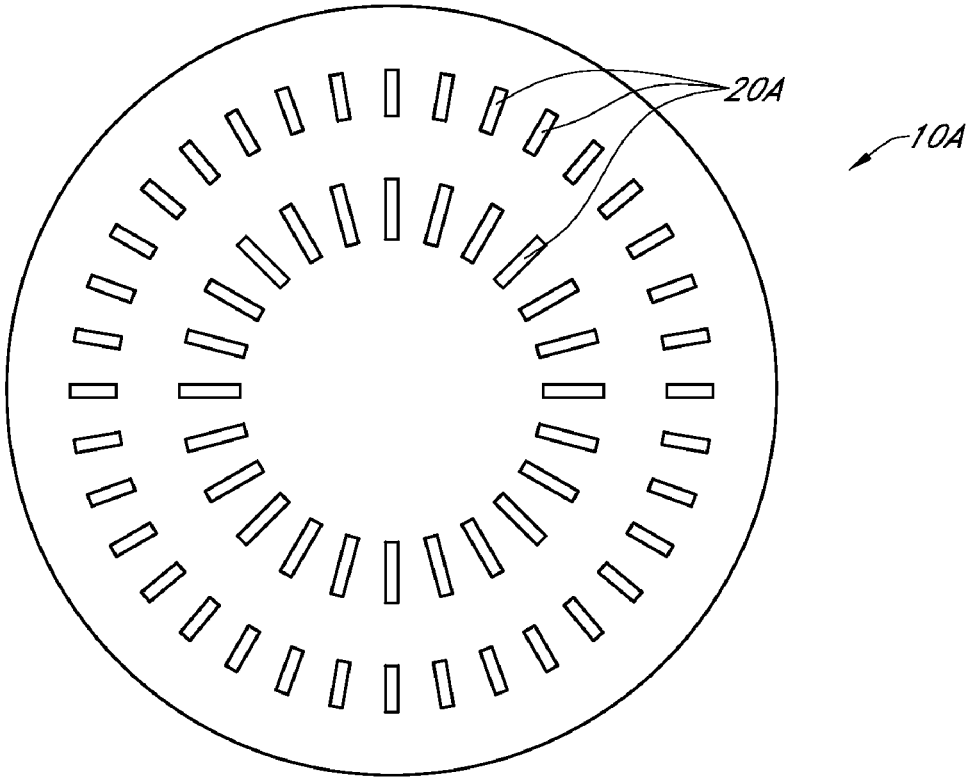
FIG. 2 is a top view of an anti-splash device according to another embodiment.

With reference to FIG. 2, an anti-splash device 10A can comprise rectangular openings 20A. In the illustrated embodiment, the openings 20A are positioned generally radially from the center of the anti-splash device 10A. As shown, the openings 20A can be positioned along different rows relative to the center of the device 10A. As discussed and/or illustrated herein in relation to other embodiments, the shape, size, spacing, location and/or other characteristics of the openings 20A can vary.

Figure 3A:
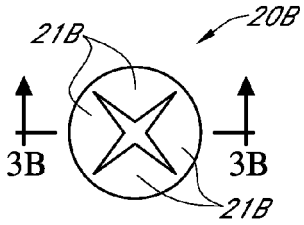
FIG. 3A is a top view of an opening in an anti-splash device according to one embodiment.
Figure 3B:
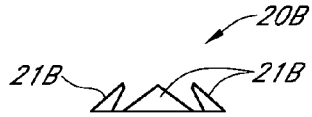
FIG. 3B is a cross-sectional view of the opening of FIG. 3A.

FIGS. 3A and 3B illustrate another embodiment of an opening 20B for an anti-splash device. As shown, the opening 20B can be formed by making an X-shaped incision in a surface of the anti-splash device. Such an incision or other cut can create four flap members 21B. The effective area of the opening 20B can be adjusted by either lifting or lowering the flap members 21B relative to the surface of the anti-splash device from which the flap members 21B were created. In addition, depending on the materials from which they are created, the flap members 21B can be stiff or flexible. It will be appreciated that an opening 20B can be created using more or fewer flap members 21B. Further, the incision or other cut used to form the opening 20B can have a different shape, size or general configuration than illustrated in FIGS. 3A and 3B.

Figure 4A:
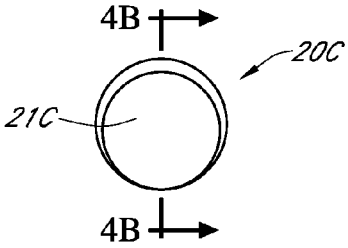
FIG. 4A is a top view of an opening in an anti-splash device according to another embodiment.
Figure 4B:
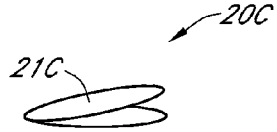
FIG. 4B is a cross-sectional view of the opening of FIG. 4A.

With reference to FIGS. 4A and 4B, an opening 20C can be formed using a generally circular flap member 21C. The flap member 21C can be configured to maintain a position away from the surface of the anti-splash device in order to permit fluids (e.g., liquid beverage, air, etc.) to pass therethrough. As discussed, the quantity, shape, size and other properties of the flap member 21C can vary as desired or required by a particular application or use. The various openings discussed above, or variations thereof, can be positioned on any embodiments of an anti-splash device described and/or illustrated herein.

The anti-splash device 10 can be manufactured from one or more flexible, rigid and/or semi-rigid materials. For example, an anti-splash device 10 can comprise polyethylene, high molecular weigh polyethylene, polypropylene, polyethylene terephthalate, polyester, polycarbonate, nylon, polystyrene, epoxy, acrylic, foam material, polymers and other thermoplastic materials, etc. In other embodiments, an anti-splash device 10 comprises other synthetic and/or natural materials, such as for example, paper (including coated and/or impregnated paper or fiber products) or wood-based products (e.g., cardboard), fabric, rubber, metal (e.g., stainless steel), ceramic and/or any other material. Regardless of the exact materials used, the anti-splash devices can be configured to advantageously maintain their physical and structural integrity during at least a single use (e.g., one 8-16 ounce beverage).

Thermoplastic anti-splash devices can be manufactured using one or more molding methods, such as, for example, injection molding, blow molding, compression molding, vacuum forming, thermoforming, thermomolding or the like. Alternatively, the devices may be punched, cut, cast, rolled or otherwise manufactured into desired sizes, shapes, thicknesses and configurations. For example, the anti-splash devices can be cut into a desired shape from large sheets of cardboard, plastic or the like.

In some embodiments, the anti-splash device can include a coating, film or other layer to further protect the device against aggressive liquids, harmful materials, elevated temperatures or other possibly detrimental environments to which the device may be exposed. For example, an anti-splash device manufactured from cardboard or other paper-based material can include a wax coating to protect against damage resulting from liquid penetration and/or elevated temperatures, degradation due to acidity and/or other potentially harmful effects resulting from contact with a beverage (e.g., coffee, tea, water, etc.).

In order to minimize or prevent undesirable sloshing, splashing and/or spilling of a beverage, an anti-splash device can be positioned between the liquid surface of the beverage and the top of the container through which the beverage discharges. The anti-splash device can be secured to or otherwise positioned within a container using one or more methods. As discussed in greater detail herein, in some embodiments, the anti-splash device is sized, shaped and otherwise configured to be snugly positioned at or near the brim of a cup or other container.

Regardless of its exact configuration or design, an anti-splash device can help prevent the undesirable movement of liquid contained below it. The device may act as a barrier to reduce or prevent the sloshing or splashing of a beverage. The reduction or prevention of such undesirable liquid movements can help avoid spills, dangerous burns and the like. This can be especially important for cups and other containers that are subject to persistent, strong and/or sudden movements, such as, for example, disposable coffee cups subjected to the movement of a user who is walking or driving, cups or other containers served on airplanes and trains and the like. In addition, such anti-splash devices can help reduce the rate of heat loss out of the container. Further, the anti-splash devices can be configured to form a better seal at the seam of a cup or other container, thereby reducing the likelihood of leaky connections between the cup and the lid or other closure device. Moreover, the anti-splash device can help enhance the structural integrity of the cup, especially at or near the location where the anti-splash device contacts the cup. For example, an anti-splash device which is configured to snugly fit within and contact the interior walls of a cup can help maintain the shape the cup (e.g., generally circular) even when internal or external forces are exerted on the cup (e.g., by grasping or otherwise handling the outside of the cup).

The openings of an anti-splash device can advantageously permit liquid to easily flow through the device during dispensing or drinking from the container. For example, when a user wishes to consume a beverage (e.g., coffee, tea, etc.), he or she can simply tilt the cup as he or she would normally do. Coffee or another beverage positioned below the anti-splash device is able to flow through the openings of the device and toward a user. In some embodiments, the rate and pattern of liquid flow through the openings of the anti-splash device can be identical or substantially identical to liquid flow when no anti-splash device is used. However, in other embodiments, the anti-splash device can be configured to slow the flow through the device. To accomplish this, the number, size, shape and/or other properties of the openings can be advantageously modified.

In some embodiments, the anti-splash device can be configured to simply float on top of a beverage surface. Thus, it may be desirable for at least a portion of the anti-splash device to have a density which is lower than that of the beverage. For example, the anti-splash device can comprise one or more materials that have a relatively low density, such as polystyrene, foam and/or the like. Alternatively, the anti-splash device can include air pockets, voids and/or one or more other features, materials or components to help it float on the liquid surface. In such arrangements, the anti-splash device can move to generally correspond with the orientation and position of the liquid surface in the cup. Therefore, the vertical position of the anti-splash device relative to a cup's walls can change as a volume of beverage is added to or removed from a cup. Further, a floatable anti-splash device can be configured to rotate as the cup is tilted or otherwise moved.

As discussed, the shape of the anti-splash device can be generally planar and/or non-planar irrespective of whether or not the anti-splash device is free-floating or is secured to one or more portions of the cup. For example, the anti-splash device can be convex, concave, domed, spherical, conical, fluted, wavy, curled, grooved, channeled, irregular-shaped and/or the like.

The outer diameter of the anti-splash device can be equal to or smaller than the inner diameter of a cup into which the device may be inserted. Thus, the anti-splash device can fit loosely within the interior of a cup or other container. However, depending on the shape and dimensions of the cup, the anti-splash device may not be capable of lowering beyond a particular cup depth.

Figure 5:
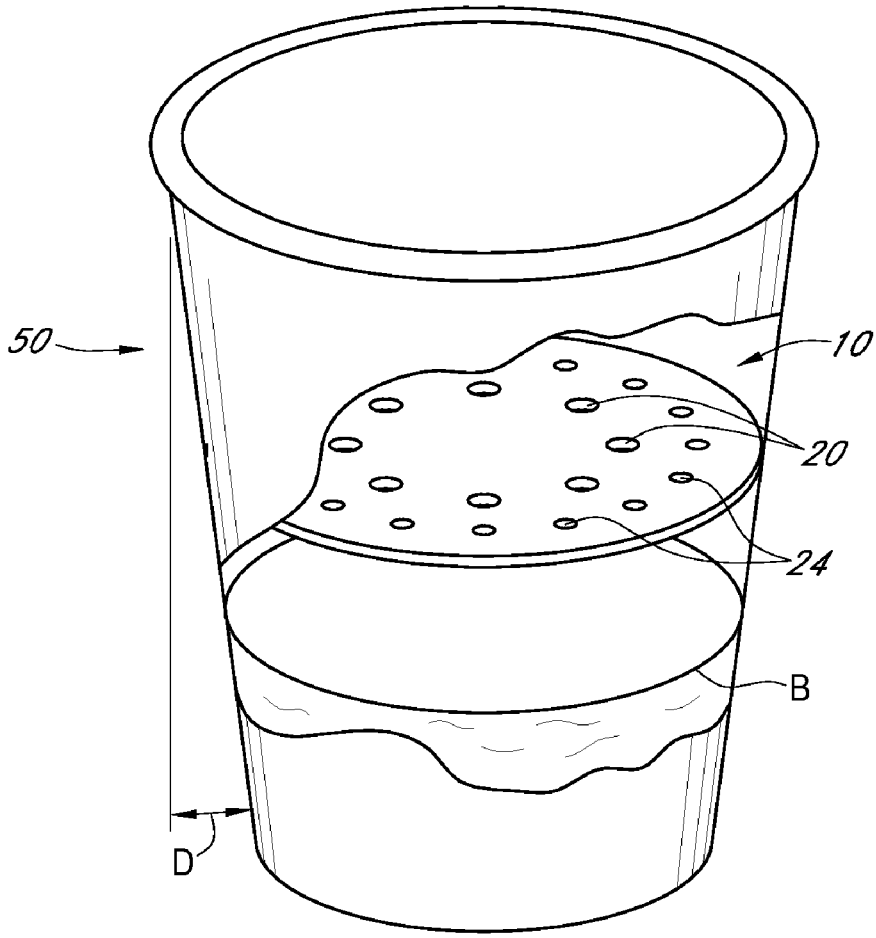
FIG. 5 is a perspective view of one embodiment of an anti-splash device positioned within a cup.

For example, as illustrated in FIG. 5, if a cup 50 includes a draft angle D such that its inner diameter widens toward the top, an anti-splash device 10 can float on the beverage surface as long as the outer diameter of the device 10 does not contact the inner diameter of the cup 50. In such embodiments, the height of the anti-splash device 10 within the cup or other container can remain generally fixed when the beverage level B drops below a particular height. In other embodiments, the diameter of the device 10 can be greater than the interior diameter of the cup, so long as the device 10 comprises a deformable body whose shape can be resiliently modified.

In embodiments where the outer diameter or other outside dimension (e.g., length, width, etc.) of the anti-splash device is consistently smaller than the inner diameter of the cup, the device 10 can be configured to float on or near the beverage surface throughout the entire cup height. The anti-splash device can be sized, shaped and otherwise configured to maintain one or more gaps between the outside of the device and the inside of the cup. However, the size of such gaps can negatively affect the extent to which anti-splash devices minimize or prevent sloshing, splashing, spilling or other movement of the beverage. In addition, such gaps can influence the flowrate at which a beverage is discharged from the cup and/or the device's ability to thermally insulate a beverage.

Figure 6:
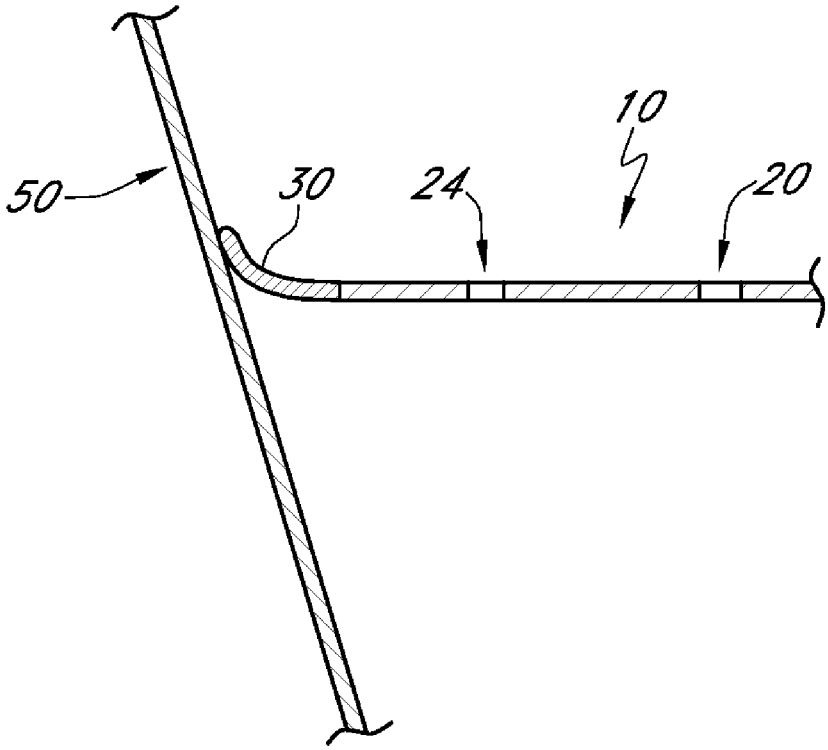
FIG. 6 is a detailed cross-sectional view of the interface between a cup wall and an anti-splash device according to one embodiment.

With reference to FIG. 6, an anti-splash device 10 can include an outer sealing portion 30 that is shaped, sized and otherwise configured to engage an internal wall of a cup 50. As illustrated, the sealing portion 30 can be flexible so that it can deform when a force is applied to it. In some embodiments, the entire perimeter of the anti-splash device 10 comprises such a sealing portion 30. Alternatively, only one or more perimeter regions of the anti-splash device 10 can include a sealing portion 30. A sealing portion 30 can be included regardless of the exact shape of the anti-splash device. In addition, any of the embodiments of the anti-splash device described and/or illustrated herein can comprise one or more sealing portions.

According to some embodiments, a sealing portion 30 can be an extension of the anti-splash device 10. For example, the sealing portion 30 can comprise the same or similar materials as one or more other portions of the anti-splash device 10. In some embodiments, the sealing portion 30 may be thinner and/or may have a different shape than one or more other portions of the anti-splash device 10 in order to provide the sealing member 30 with additional flexibility and/or resiliency. Alternatively, the sealing member 30 can comprise one or more different materials or features than the anti-splash device 10 or a thinner section or piece of the same material. For example, the sealing member 30 can include one or more materials that are softer and/or more flexible than those used on the sealing member 30, such as, for example, rubber, soft plastic, thin plastic or cardboard or the like.

Figure 25A:
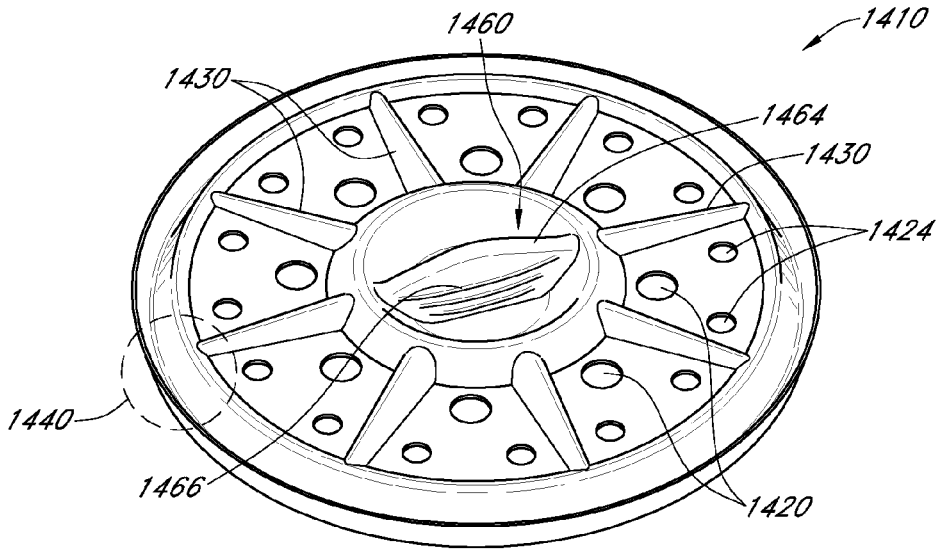
FIG. 25A is a perspective view of an anti-splash device according to yet another embodiment.
Figure 25B:
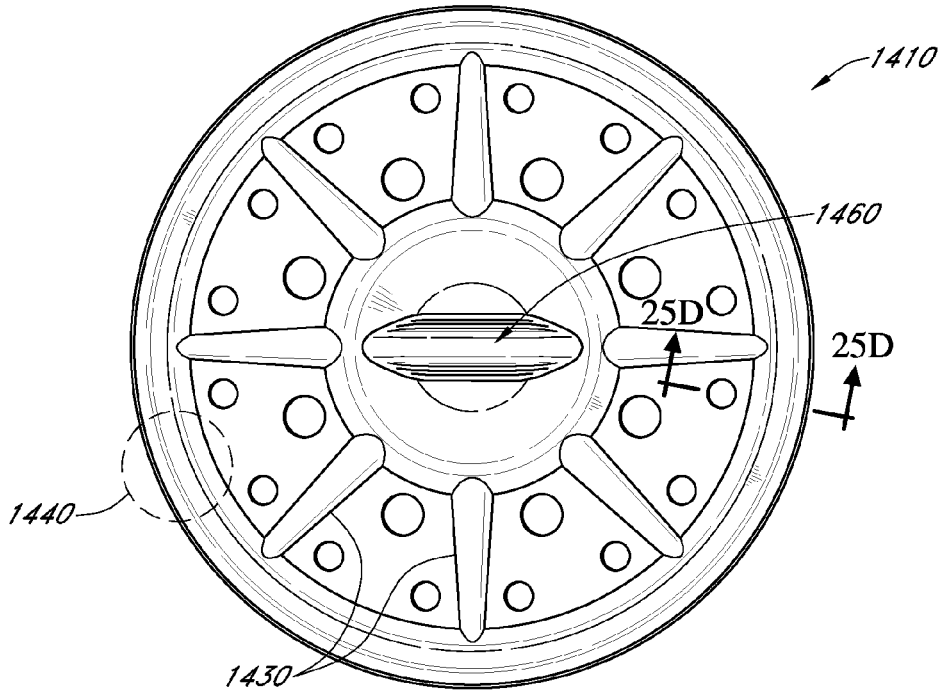
FIG. 25B is a top view of the anti-splash device of FIG. 25A.
Figure 25C:
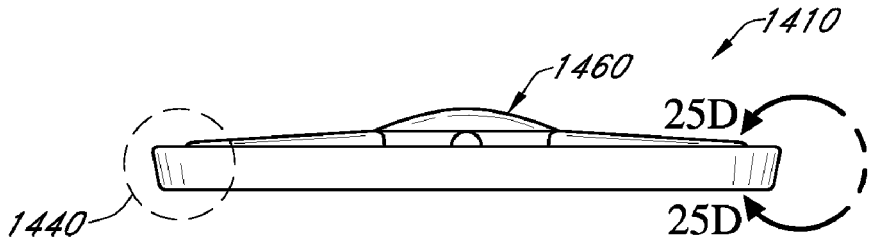
FIG. 25C is a side view of the anti-splash device of FIG. 25A.

In other embodiments, the sealing portion 30 can be a separate item that is subsequently attached to the anti-splash device 10. For example, the sealing portion 30 can be attached to the anti-splash device 10 using adhesives, friction fit connections, slip fit connections (e.g., placing an annular sealing member around a disc-shaped anti-splash device) or any other type of attachment device or method. Alternatively, an anti-splash device 10 can be glued, sonic welded, pressure bonded, laser bonded, heat bonded or otherwise attached to the interior of the cup 50. It should be appreciated that one or more of these attachment methods can be used to connect the anti-splash device 10 to the cup 50 for any of the embodiments disclosed herein. In addition, one or more of these attachment methods can be used to attach the anti-splash device 10 to a lid 500 (FIGS. 14A and 14B), an intermediate member 566 (FIG. 15) and any other portion, member or device associated with a cup or other container. In other embodiments, as illustrated in FIG. 25A, an anti-splash device can include a channel or other resilient feature along its exterior edges that allows a user to snugly position the device within a cup or other container. In such arrangements, the circumferential channel or other feature can be configured to deform (e.g., change its effective diameter or other outer dimension) when urged into a cup against the cup's interior walls.

As illustrated in FIG. 6, an anti-splash device 10 can be urged far enough into an interior cavity of a cup 50 so that the sealing portion 30 engages a wall of the cup 50. Thus, the sealing portion 30 can be used to at least temporarily secure the position of an anti-splash device 10 relative to a cup 50 (e.g., within an interior portion of a cup 50). In addition, the sealing portion 30 can help minimize heat exchange between the beverage contained underneath the anti-splash device 10 and the headspace above the anti-splash device 10. Thus, an anti-splash device 10 with a sealing portion 30 can provide certain insulating advantages. In some embodiments, it may be desirable for the anti-splash device 10 to engage the interior of the cup 50 at or near the upper portion of the cup 50 (e.g., near the cup brim). In other arrangements, as illustrated and discussed with reference to FIG. 25A, an anti-splash device can include one or more other types of features or members that are configured to engage an interior portion of the cup or other container. In yet other embodiments, an anti-splash device can be adapted to temporarily or permanently engage the interior walls of a cup or some other portion of a container.

In some embodiments, the sealing portion 30 can be sufficiently large and flexible to allow a user to position the anti-splash device 10 along various depths of the cup. In such arrangements, the sealing portion 30 can be configured to deform to a greater extent where the inner diameter of the cup 50 narrows. Thus, the vertical position of the anti-splash device 10 can be adjusted according to a user's preferences. Further, as illustrated and discussed herein with respect to certain embodiments, the anti-splash device 10 can comprise one or more gripping members (e.g., tabs, openings, handles, etc.) to facilitate positioning, re-positioning or removal of device 10.

Figure 7C:
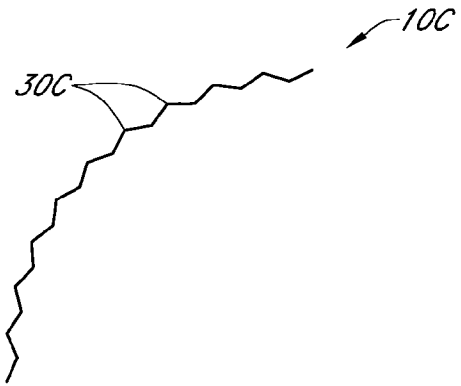
FIG. 7C is a detailed top view of the edge of an anti-splash device according to still another embodiment.
Figure 7B:
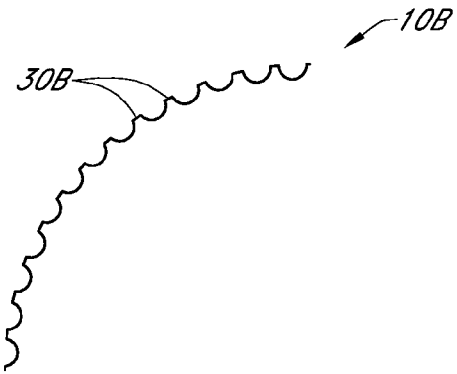
FIG. 7B is a detailed top view of the edge of an anti-splash device according to another embodiment.
Figure 7A:
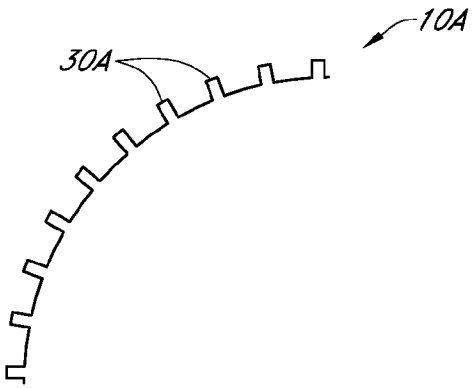
FIG. 7A is a detailed top view of the edge of an anti-splash device according to one embodiment.

As illustrated in the embodiments of FIGS. 7A through 7C, the shape of the outer perimeter of an anti-splash device can vary. In FIG. 7A, the anti-splash device 10A comprises a plurality of rectangular-shaped tabs 30A that generally extend along the outer perimeter. As shown, the tabs 30A can be equally spaced or substantially equally spaced from one another. However, in other embodiments, the spacing of the tabs 30A can vary (e.g., can be non-uniform, irregular, etc.). In some embodiments, the tabs 30A can be configured to engage an inner wall of a cup (not shown) to maintain the position of the anti-splash device 10A relative to the cup interior. For example, the tabs 30A can have a particular size, shape, stiffness or flexibility and/or other characteristics to frictionally or otherwise engage a portion of the cup interior. Alternatively, the tabs 30A can be adapted to maintain the position of the anti-splash device 10A relative to the cup by at least partially burrowing into the interior wall of a cup. The tabs 30A or other engagement members can be located along the entire perimeter of the device 10A. In other embodiments, the tabs 30A or other engagement members can be intermittently positioned along only one or more portions of the device's perimeter.

With reference to FIG. 7B, an anti-splash device 10B can include a plurality of semi-circular tabs 30B along its outer perimeter. Alternatively, as illustrated in the embodiment of FIG. 7C, the tabs 30C along the outer perimeter of an anti-splash device 10C can form a saw-tooth pattern. It will be appreciated that the outer perimeter of the anti-splash device can have a different shape, size and/or general configuration than illustrated in the embodiments illustrated and/or described herein. Further, the tabs, other engagement members and edge patterns of the devices described herein, or variations thereof, can be used on any embodiments of an anti-splash device.

The shape and other details of the perimeter of an anti-splash device can be selected to permit fluid flow between the device and the interior of a cup or other container. Thus, the tabs positioned along an outer portion of an anti-splash device can be shaped, sized and otherwise configured to serve as engagement members to secure the device within a cup and/or as gaps to permit fluid flow across the outer perimeter of the device.

Figure 8B:
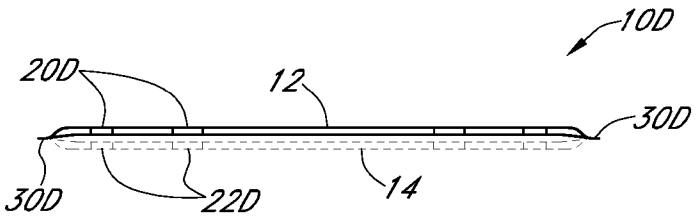
FIG. 8B is a cross-sectional view of the anti-splash device of FIG. 8A.
Figure 8A:
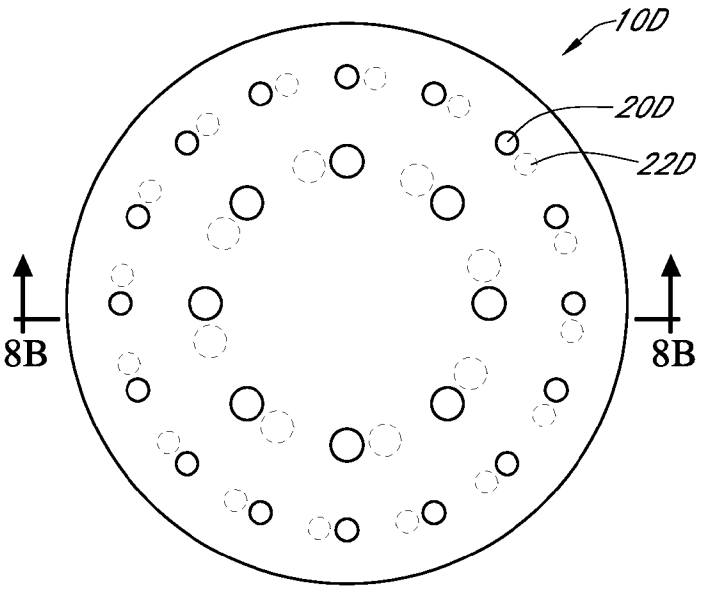
FIG. 8A is a top view of an anti-splash device comprising two sets of offset openings according to one embodiment.

FIGS. 8A and 8B illustrate another embodiment of an anti-splash device 10D. As shown, the device 10D can include an upper portion 12 and a lower portion 14. In the depicted embodiment, the upper portion 12 and lower portion 14 are joined to one another along an outer perimeter 30D of the device 10D. As discussed, the outer perimeter 30D can be configured to engage an interior portion of a cup wall. In other embodiments, the upper portion 12 and the lower portion 14 can be attached to one another along one or more other areas (e.g., along an interior area), either in lieu of or in addition to being attached along the edges. In some embodiments, one or more attachment members or features can be used to connect the upper and lower portion 12, 14 to each other.

With continued reference to FIGS. 8A and 8B, the upper portion 12 can comprise a plurality of openings 20D. As illustrated, the lower portion 14 can also include a plurality of openings 22D. The shape, size, spacing, degree of overlap and other characteristics of the openings 20D, 22D can vary as desired or required by a particular application or use. In FIG. 8A, the openings 20D in the upper portion 12 are offset from the openings 22D in the lower portion 14. It will be appreciated that the level to which the openings 20D, 22D are offset can be different than shown. For example, in some embodiments, the openings 20D, 22D are not offset at all, while in other embodiments, there is little or no overlap between the openings 20D, 22D.

In the embodiment of the anti-splash device 10D of FIGS. 8A and 8B, two layers or portions 12, 14 are positioned adjacent to each other. However, in other arrangements, the device 10D can include more or fewer layers or portions. In some embodiments, the adjacently located layers or portions 12, 14 can be configured to rotate relative to each other. Thus, the amount of overlap or offset between openings 20D, 22D in adjacent portions 12, 14 can be selectively adjusted by a manufacturer and/or a user. In such arrangements, the anti-splash device 10D can comprise a locking member or other feature to maintain the desired overlap between the openings 20D, 22D during use.

Anti-splash devices having multiple layers or portions can assist in controlling the flow of fluids (e.g., liquid beverage, air, etc.) through the anti-splash device 10D. In addition, such embodiments can provide thermal insulation benefits by preventing or minimizing the direct exposure of a liquid or other substance to the ambient air located above the device 10D.

For clarity, many of the embodiments of the anti-splash device discussed and/or illustrated herein include a generally planar shape. However, as discussed, it will be appreciated that the anti-splash devices can be modified to include one or more non-planar shapes, such as, for example, convex, concave, domed, spherical, conical, fluted, wavy, curled, grooved, channeled, irregular-shaped and/or the like.

Figure 9A:
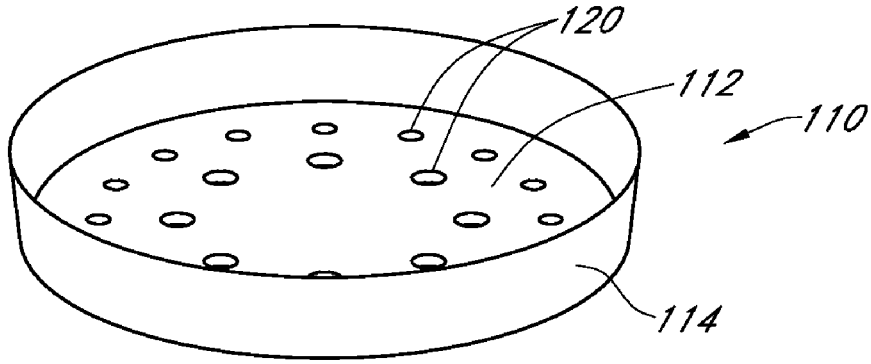
FIG. 9A is a perspective view of another embodiment of an anti-splash device.

FIG. 9A illustrates another embodiment of an anti-splash device 110. Similar to other embodiments discussed herein, the depicted anti-splash device 110 can include a main body portion 112 comprising a plurality of openings 120. The anti-splash device 110 can further include one or more engagement portions 114 along at least a portion of its perimeter. As shown, the engagement portion 114 can include a substantially cylindrical shape and may be generally perpendicular to the adjacent main body portion 112. Moreover, the main body portion 112 can be attached to the engagement portion 114 at or near the edge of the engagement portion 114. However, it will be appreciated that the main body portion 112 and/or the engagement portion 114 can have a different shape, size or configuration. For example, the main body portion can have a different shape (e.g., polygonal, oval, non-planar, planar, convex, concave, domed, spherical, conical, fluted, wavy, curled, grooved, channeled, irregular-shaped, etc.), the main body portion 112 can attach to the engagement portion 114 along a different surface or region of the engagement portion 114 or the like.

Some or all of the anti-splash devices described and/or illustrated herein, or variations thereof, can comprise one or more flexible, rigid and/or semi-rigid materials, such as thermoplastics, paper based products (e.g., cardboard, etc.) or the like. Further, the anti-splash devices can be disposable or reusable. Likewise, the cups, mugs or other containers into which such anti-splash devices can be placed may vary. For example, the anti-splash devices can be placed within disposable cups (e.g., paper, coated cardboard, plastic, etc.), reusable travel mugs or other container, foodstuff containers and the like. In addition, such cups or containers may be small or large, and may comprise any flexible, rigid or semi-rigid material.

Figure 9B:
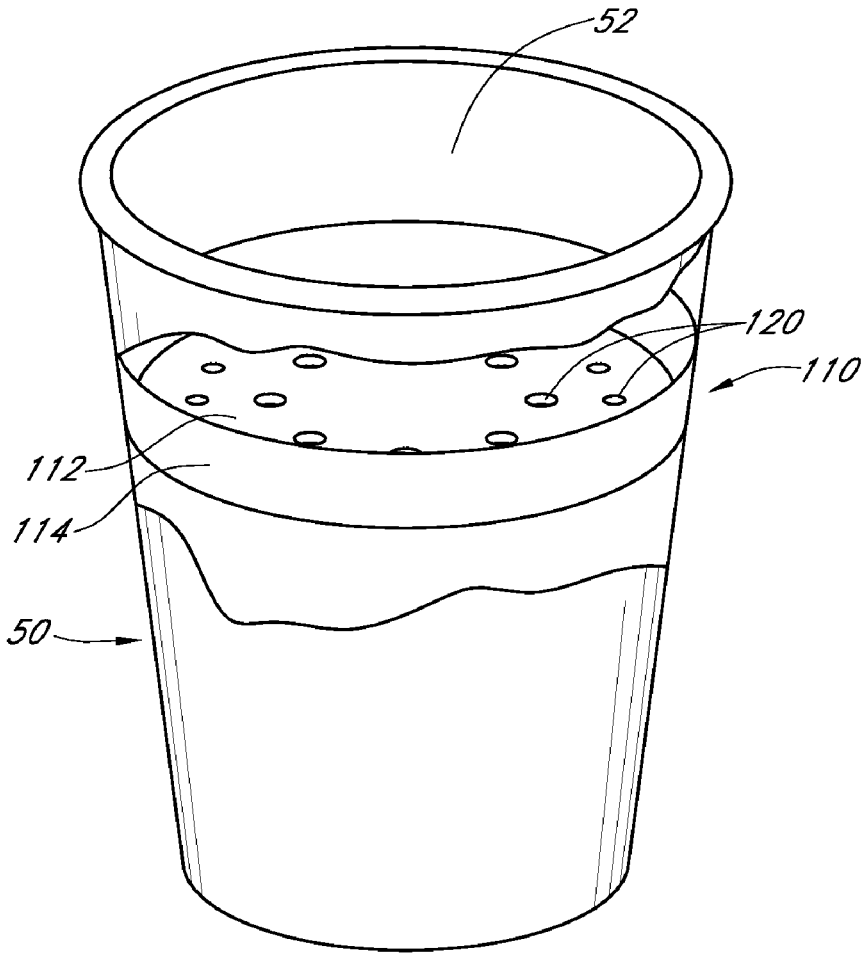
FIG. 9B is a perspective view of a cup with a portion of the cup wall hidden to reveal the anti-splash device of FIG. 9A positioned therein.

FIG. 9B illustrates one embodiment of an anti-splash device 110 positioned within a cup 50. The depicted device 110 includes a main body portion 112 and a cylindrical or substantially cylindrical engagement portion 114, which may be adapted to engage an interior surface of the cup 50. In some embodiments, the cylindrical or substantially cylindrical engagement portion 114 is configured to generally conform to the shape of the cup wall (e.g., cylindrical, generally cylindrical with a draft angle or other feature, etc.). In use, the anti-splash device 110 may be inserted through the top opening 52 of the cup 50 and urged or otherwise moved downwardly until the engagement portion 114 frictionally contacts at least a portion of the cup's interior wall. The anti-splash device 110 can be urged downwardly as described above either before or after a beverage has been poured into the cup 50. In some arrangements, as discussed with reference to the embodiments of FIGS. 23A and 25A, the engagement portion can be configured to generally conform to the shape of the cup wall. In one embodiment, the further that the anti-splash device is urged downwardly into the interior of the cup or other container, the more that the engagement portion generally takes on the shape of the adjacent wall with which it is in contact.

Alternatively, an anti-splash device 110 can be inserted into a cup when the top surface of the beverage is above the depth at which the device 110 frictionally engages an interior surface of the cup 50. Thus, the anti-splash device 110 can float or substantially float on or near the top surface of the beverage until the beverage level is sufficiently lowered. In embodiments where the device 110 is not configured to float on the beverage surface, the anti-splash device 110 can sink until the engagement portion 114 contacts the cup's interior wall. Depending on whether the cup and/or the anti-splash device 110 are disposable, the anti-splash device 110 can be recovered from the cup 50 after use. If the anti-splash device 110 is reusable, it may be removed from the cup interior for washing or the like. In order to assist a user in positioning the anti-splash device 110 into and out of a cup 50 or other container, the device 110 can comprise one or more tabs, openings, handles or other gripping members (not shown).

In some embodiments, an anti-splash device can be adapted for placement on or near a protrusion member located along an interior of a cup or other container. For example, a cup can comprise one or more flanges, tabs, lips, ridges or the like that extend from its interior wall at one or more desired depths. Thus, as it is lowered into the cup, an anti-splash device can contact such protrusion members and be retained thereon. In other configurations, a cup can include both upper and lower protrusion members extending from its interior surface to maintain an anti-splash device between a desired lower and upper depth.

Regardless of how anti-splash devices interface with cups, when a cup is tilted or otherwise moved, the rate at which a beverage flows upwardly across the device can be slower than the rate at which air flows downwardly across the device. As discussed, in some embodiments, the rate of liquid flow through the device can be identical or similar to that when no device is used. Further, the openings and other features of an anti-splash device can be configured to permit a liquid to quickly pass across it when a cup is being filled.

Figure 10:
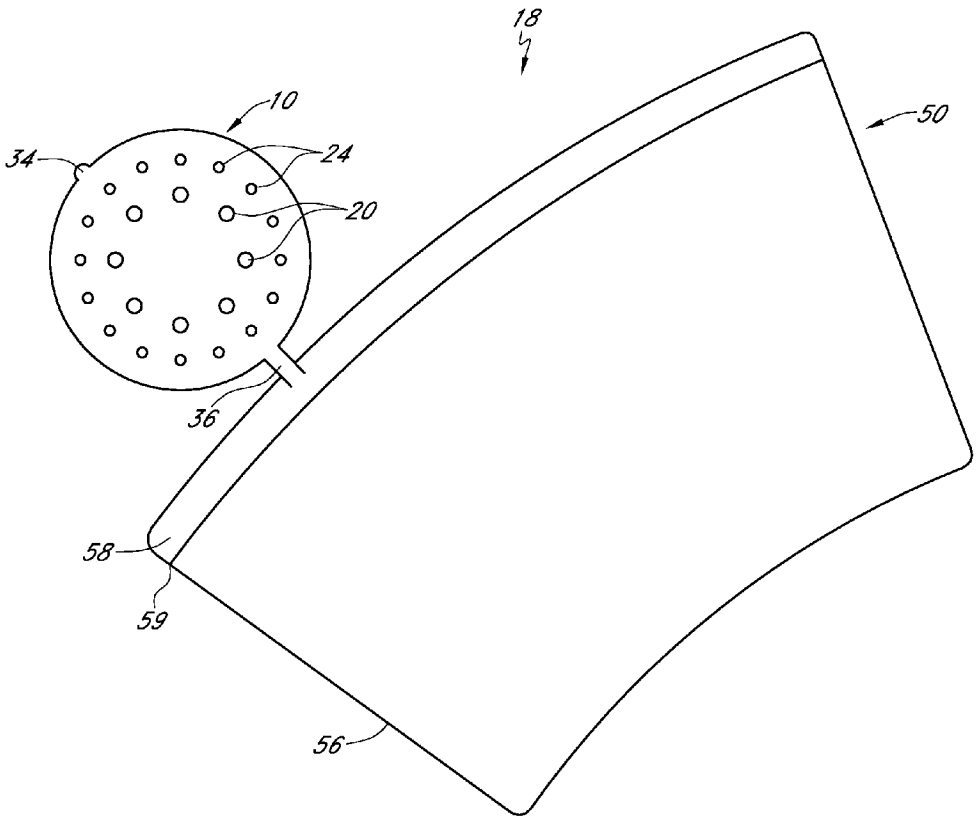
FIG. 10 is top view of a paper cutout configured to be formed into a cup comprising an anti-splash device according to one embodiment.

FIG. 10 illustrates a main body cutout pattern 18 which is configured to be formed into a disposable cup having an attached anti-splash device 10. Such a pattern 18 can be manufactured from paper, plastic, other synthetic and/or natural materials and/or the like. The pattern 18 can be cut from a die, punched, molded (e.g., using injection molding, compression molding, thermoforming or other molding techniques) or the like. The depicted cutout pattern 18 can be subsequently rolled and/or otherwise shaped and assembled to form a cup 50. For example, the free ends of the main cup portion 56 can be glued, sonic welded or otherwise attached to each other to form the substantially cylindrical part of the cup 50. In addition, a bottom portion (not shown) can be attached to a lower area of the main portion 56 to complete the cup design. Alternatively, the lower part of the main cup portion 56 can be shaped to form the cup bottom.

As illustrated, an upper portion 58 of the pattern 18 can be configured to define the upper rim of the assembled cup 50. With continued reference to FIG. 10, the pattern 18 can optionally include a score 59, step and/or other delineating feature that separates the upper portion 58 from the main generally cylindrical portion 56 of the cup 50. The upper portion 58 can be sized, shaped and otherwise configured to receive a lid or other attachment member along its rim.

With continued reference to FIG. 10, an anti-splash device 10 can be attached to the upper portion 58 of the pattern 18. In the illustrated embodiment, the anti-splash device 10 is attached to the pattern 18 using a single extension tab member 36. However, one or more other methods can be used to attach an anti-splash device 10 to the pattern 18, either in lieu of or in addition to using an extension tab member 36. For example, the anti-splash device 10 can be glued, sonic welded or otherwise connected to the cup 50. In other embodiments, the pattern can comprise two or more tab members 36 that connect the anti-splash device 10 to a cup 50. Alternatively, as discussed, the cup 50 can include a protrusion and/or a slot configured to receive an anti-splash device 10.

Once formed from the pattern 18, the cups 50 can be advantageously placed within each other and packaged for storage and/or transport. The anti-splash devices 10 can remain outside the formed cup 50 during packaging. In such an arrangement, the anti-splash devices can be protected during storage and/or transport. Thus, a user can move the anti-splash device 10 into the cup interior after a beverage has been poured therein. The anti-splash device can remain attached to the upper portion 58 or other location of the cup 50 while the cup 50 is being used. In one embodiment, the score 59 or step in the cup 50 can be used as a ledge or similar resting surface to engage a lower surface of the anti-splash device 10 when the device 10 is lowered into the cup 50.

To ensure that the anti-splash device 10 has been adequately and securely positioned within the cup interior, the device 10 can comprise one or more engagement members along its perimeter, as described herein. For example, the anti-splash device 10 can include one or more protrusions 34 or openings along its perimeter that engage a portion of the cup interior. Such a protrusion 34 can facilitate the handling (e.g., lifting, lowering, repositioning, etc.) of the anti-splash device 10.

Figure 11A:
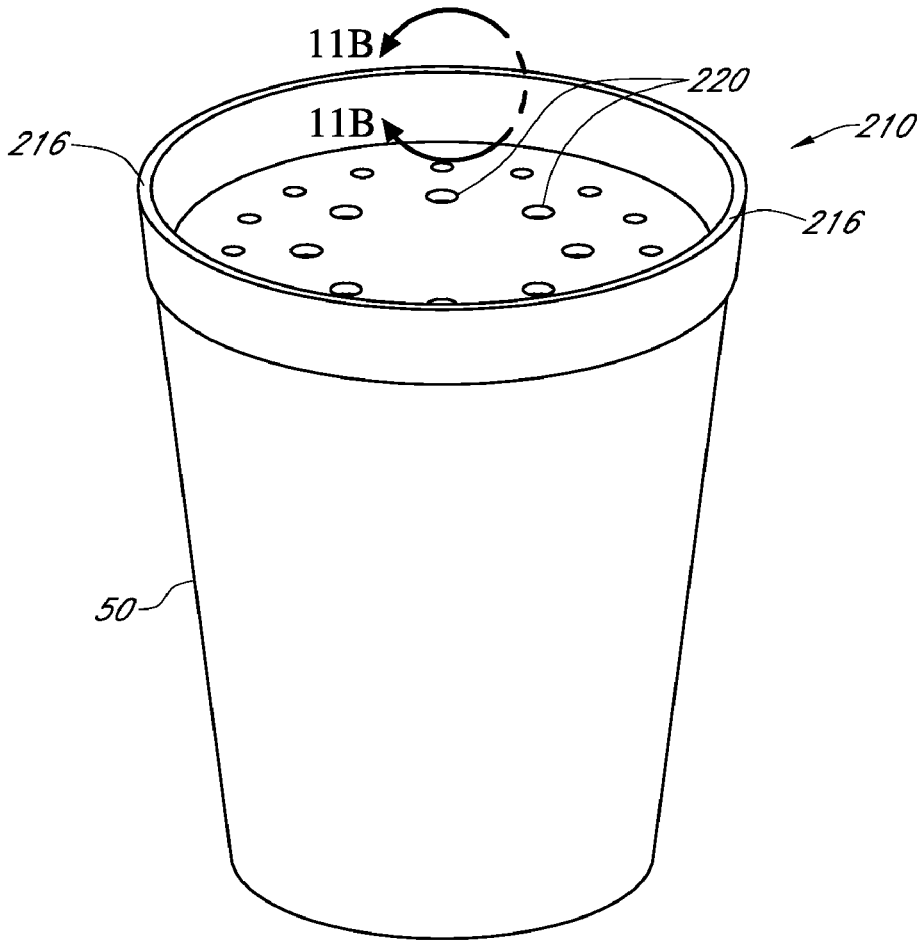
FIG. 11A is a perspective view of another embodiment of an anti-splash device positioned within a cup.
Figure 11B:
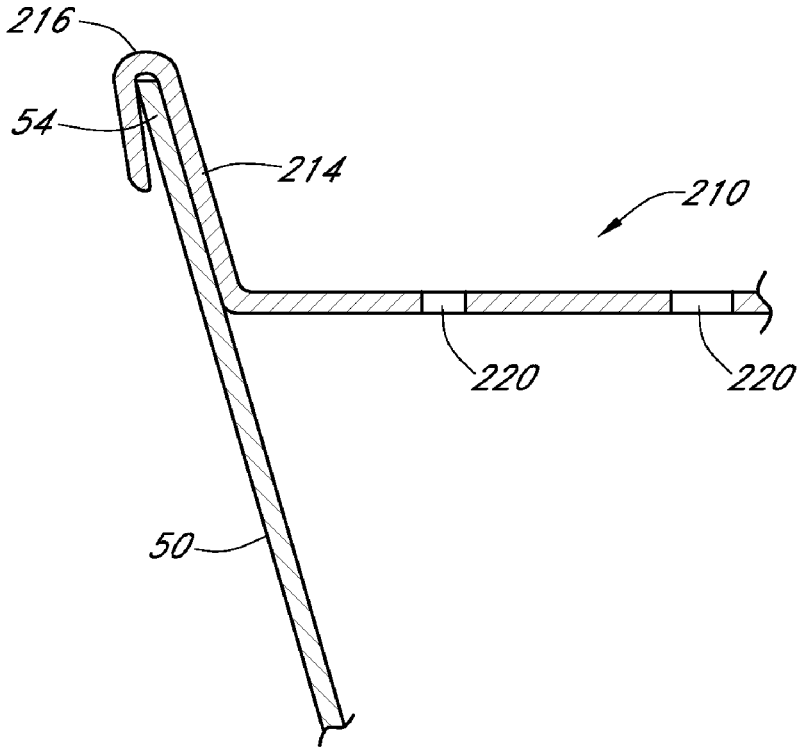
FIG. 11B is a detailed cross-section view of the cup and anti-splash device of FIG. 11A.

With reference to FIGS. 11A and 11B, an anti-splash device 210 can comprise an upper flange or lip 216 that may be configured to grasp the brim 54 or other upper portion of a cup 50. The illustrated anti-splash device 210 is similar to the embodiment of FIGS. 9A and 9B. However, the depicted device 210 additionally comprises a lip 216 extending circumferentially from the engagement member 214. As with other embodiments described and illustrated herein, the anti-splash device 210 can include a plurality of openings 220 distributed along the substantially horizontal main body portion 214. In addition, the anti-splash device 210 can have any generally planar and/or non-planar shape, such as, for example, convex, concave, domed, spherical, conical, fluted, wavy, curled, grooved, channeled, irregular-shaped and/or the like. As illustrated in FIG. 11A, when properly secured to a cup's brim, the anti-splash device 210 can surround the entire top opening of that cup 50. The lip 216 of the anti-splash device 210 can be adapted to squeeze, pinch or otherwise securely retain the anti-splash device 210 on the cup 50.

Figure 11C:
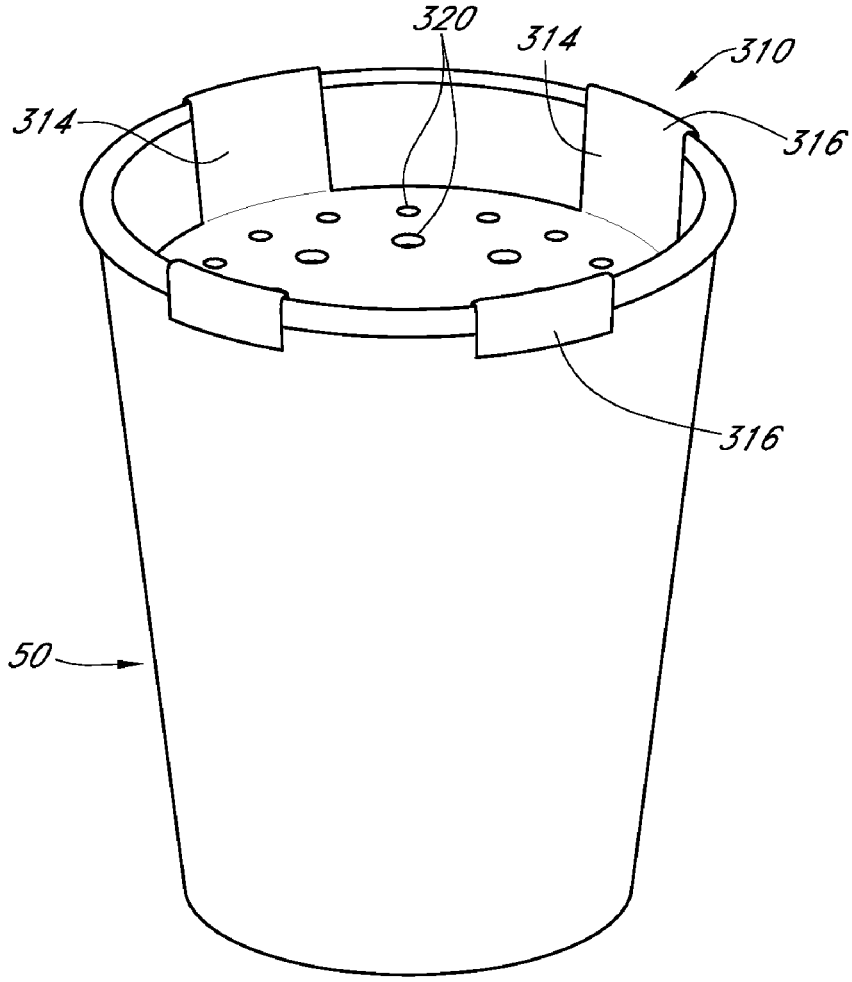
FIG. 11C is a perspective view of yet another embodiment of an anti-splash device positioned within a cup.

In other embodiments, as illustrated in FIG. 11C, the anti-splash device 310 is configured to intermittently engage an upper portion of the cup 50 (e.g., only in certain locations). As shown, the anti-splash device 310 can grasp the brim of the cup 50 in four different areas. It will be appreciated that an anti-splash device 310 can include more or fewer lip members 316 than shown in the embodiment of FIG. 11C. In addition, the shape, size, dimensions, position, spacing, method of securement to the cup 50 and/or other details of the lip members 316 can vary.

Figure 13A:
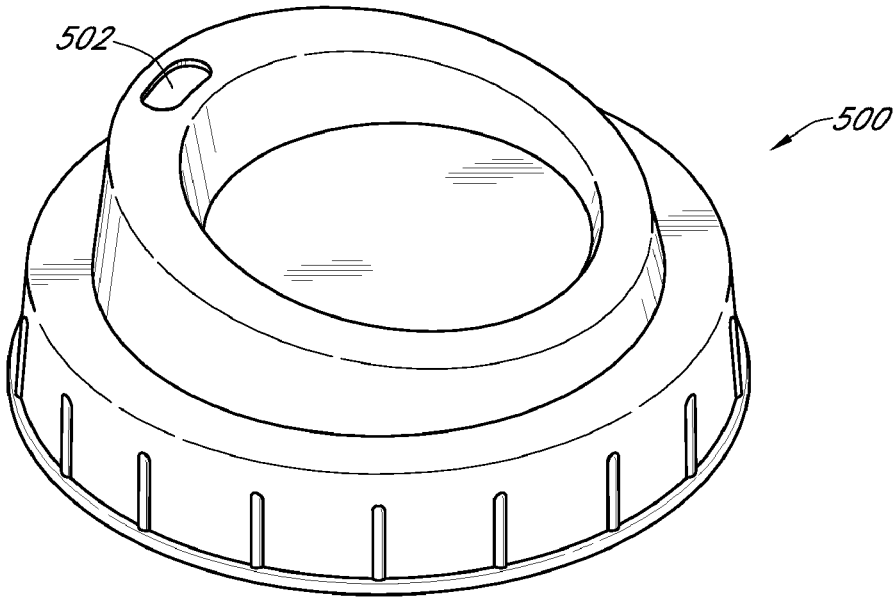
FIG. 13A is a perspective view of one embodiment of a cup lid configured to receive an anti-splash device.

The anti-splash devices depicted in FIGS. 11A through 11C, as well as other embodiments discussed and/or illustrated herein, can be further secured to a cup in which they are positioned by covering the cup with a lid. For example, the lid 500 illustrated in FIGS. 13A through 13C can be placed on the brim of a cup. Preferably, such a lid 500 can be configured to secure to the upper portion of a cup even when an anti-splash device 210, 310 is used. Such lids 500 can comprise a sipping hole 502 and one or more vent holes 503 for convenient access into the interior of a cup.

Figure 13B:
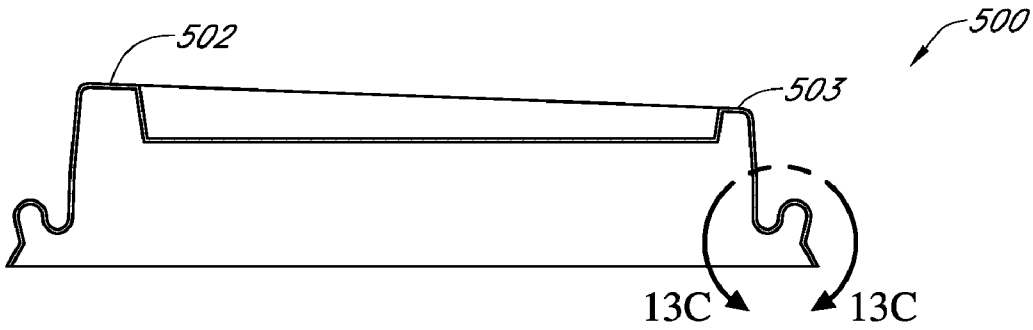
FIG. 13B is a cross-sectional view of the cup lid of FIG. 13A.
Figure 13C:
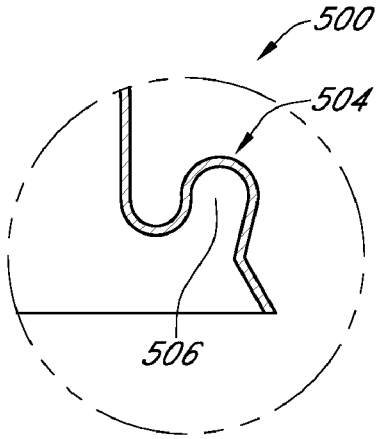
FIG. 13C is a detailed cross-sectional view of an outer portion of the cup lid of FIG. 13A.

With continued reference to FIGS. 13B and 13C, a lid 500 can include a resilient circumferential edge 504 that is adapted to receive the brim of a cup within an inner loop region 506. In one embodiment, the lid 500 can be pressed downwardly against the cup's top opening until the brim of the cup snaps or is otherwise positioned into the loop region 506 of the lid 500. The resilient circumferential edge 504 of the lid 500 can help ensure that the rim of the cup remains within the loop region 506. The snapping feature of the lid's resilient edge 504 can be configured to engage both the brim and the lip 216 (FIGS. 11A and 11B) or lip members 316 (FIG. 11C) of an anti-splash device 210, 310.

Figure 12A:
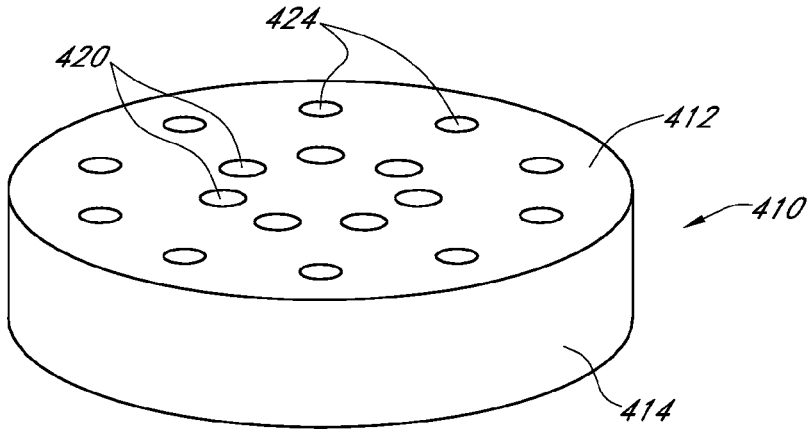
FIG. 12A is a perspective view of one embodiment of an anti-splash device configured to be retained by a lid or other cover member for a cup.
Figure 12B:
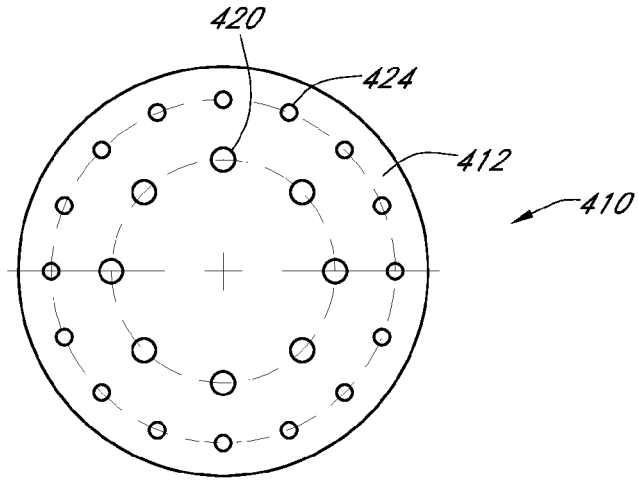
FIG. 12B is a top view of the anti-splash device of FIG. 12A.
Figure 12C:
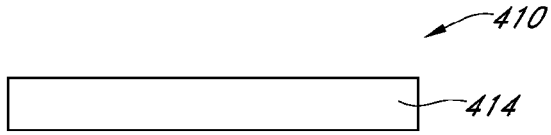
FIG. 12C is a side elevation view of the anti-splash device of FIG. 12A.

FIGS. 12A through 12C illustrate one embodiment of an anti-splash device 410 that can be adapted to attach to or fit within a portion of a cup lid. As shown, the anti-splash device 410 can include a cylindrical engagement portion 414 and a main body portion 412 comprising a plurality of openings 420. In some embodiments, the engagement portion 414 and the main body portion 412 are molded, cut and/or otherwise formed from a unitary member. Alternatively, the engagement portion 414 and the main body portion 412 can be separate items that are subsequently joined using one or more attachment methods. The anti-splash device 410 can be shaped, sized, dimensioned and/or configured differently than depicted in FIGS. 12A through 12C. For example, device 410 can have a polygonal, oval or other shape. In addition, the main body portion 412 can have any planar and/or non-planar shape as discussed herein. In other embodiments, the engagement portion 414 can be taller or shorter, or may not be continuous around the periphery of the anti-splash device 410.

As illustrated in FIGS. 12A and 12B, the main body portion 412 of the anti-splash device 410 can include an inner row of openings 420 and an outer row of openings 424. In one embodiment, the outside diameter of the main body portion 412 is approximately 3 inches, and the height of the engagement portion 414 is approximately 0.4 inches. In addition, the main body portion 412 can comprise eight evenly-spaced 3/16-inch diameter openings 420 along the inner row. In addition, the main body portion 412 can include sixteen evenly-spaced 1/8-inch diameter openings 424 along the outer row, positioned closer to the periphery of the anti-splash device 410. In some embodiments, the 3/16-inch diameter openings 420 and the 1/8-inch diameter openings 424 can be positioned approximately 0.8 inches and 1.25 inches from the center of the anti-splash device 410, respectively.

It will be appreciated that the shape, size, dimensions (e.g., diameter, thickness, height, etc.) and/or other properties of the anti-splash device 410 can vary. Likewise, the shape, quantity, size, position, spacing and other properties of the openings 420, 424 can also be different than illustrated or discussed herein.

Figure 14A:
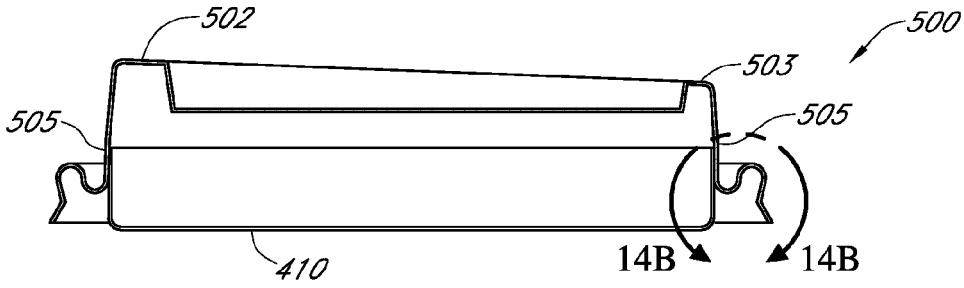
FIG. 14A is a cross-sectional view of the cup lid of FIG. 13A comprising an anti-spill device along a lower portion.
Figure 14B:
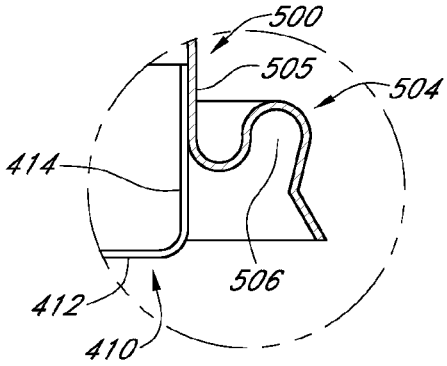
FIG. 14B is a detailed cross-sectional view of an outer portion of the lid and anti-splash device of FIG. 14A.

FIGS. 14A and 14B illustrate the anti-splash device 410 similar to the one depicted in FIGS. 12A through 12C positioned within a lower portion of a cup lid 500. As discussed, the lid 500 can include a sipping hole 502 and one or more vent holes 503. In addition, the lid 500 can include a resilient circumferential edge 504 that is adapted to receive the brim of a cup within an inner loop region 506. As illustrated, the lower opening of the lid 500 can be configured to receive an anti-splash device 410. In some embodiments, the anti-splash device 410 is sized, shaped and otherwise adapted to snugly fit within a cylindrical portion 505 of the lid 500.

With continued reference to FIGS. 14A and 14B, the anti-splash device 410 and the lid 500 can be joined by frictionally press-fitting the device 410 within the cylindrical portion 505. In order to ensure that the anti-splash device 410 can be adequately urged into the lid 500, the lid can include a tab or other protrusion member against which the engagement portion 414 of the device 410 is configured to stop or engage. In addition to or in lieu of the protrusion member, the lid can comprise a positive engagement member or some other indicia (e.g., a member configured to click or make another sound) that the device 410 has been properly positioned within a lid 500. In other embodiments, the anti-spill device 410 and the lid 500 can be joined using one or more other methods, such as, for example, using adhesives, clips, screw connections, fasteners or the like.

Therefore, such anti-splash devices 410 can be manufactured separately from lids 500 and subsequently connected to them by a manufacturer, user, vendor or some other party. Preferably, the devices 410 can be manufactured in a variety of shapes and sizes to fit different types of commercially available lids. Alternatively, the lid and anti-splash device combination depicted in FIGS. 14A and 14B can be manufactured as single unit. Depending on whether the lid 500 and/or the anti-splash device 410 are disposable or re-usable, the device 410 can be configured to be removed from the lid 500 after use. It will appreciated that other embodiments of an anti-splash device as discussed and/or illustrated herein can be configured to removably or permanently attach or join to a lid.

The size, shape, configuration and/or other characteristics of the anti-splash devices discussed herein can be selected to facilitate the packaging, transport, storage and/or other activities associated with the handling of such devices. In addition, anti-splash devices can be packaged so as to permit a user to easily and hygienically dispense them. In fact, a user may be allowed to attach an anti-splash device 410 of FIGS. 12A through 12B, or any other anti-splash device discussed or illustrated herein, without physically handling it, such as by pressing it into the lid while holding the lid.

Figure 15:
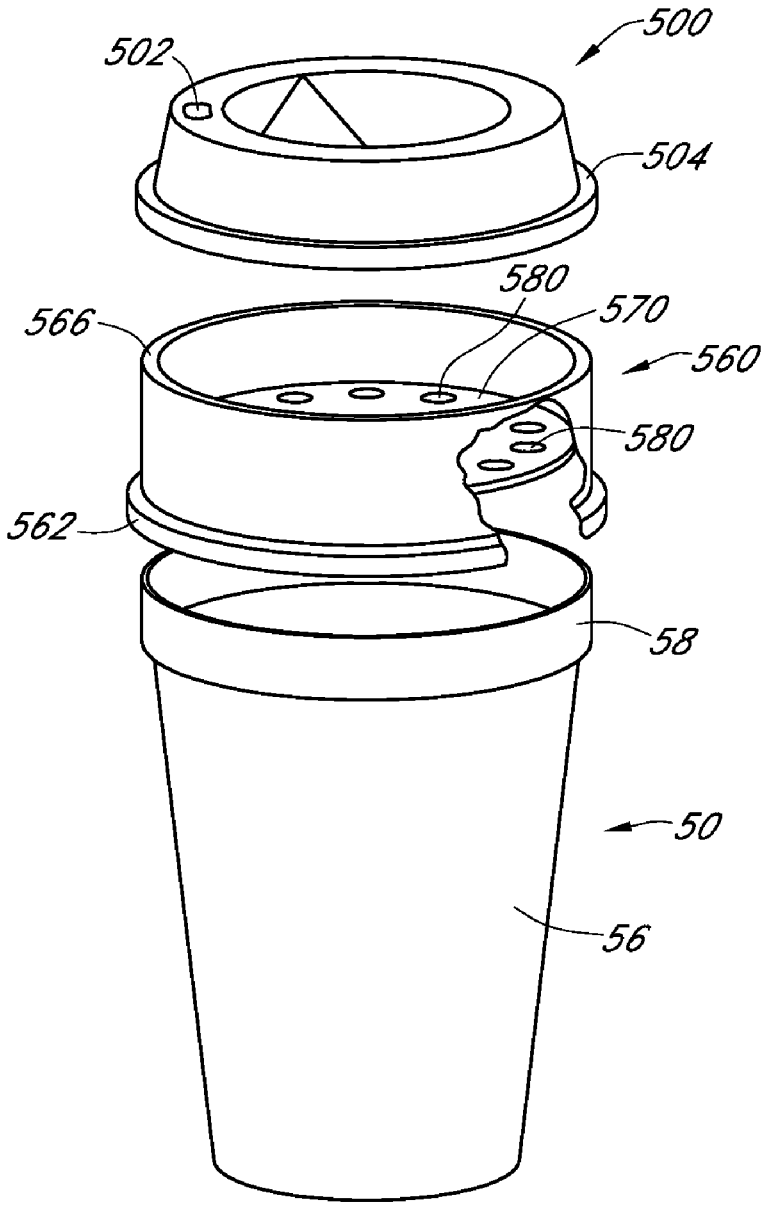
FIG. 15 is a perspective view of an embodiment of an intermediate member comprising an anti-splash device and configured to receive a cup rim on one end and a lid on another end.

FIG. 15 illustrates one embodiment of an intermediate member 560 comprising an internal anti-splash member 570. As shown, the intermediate member 560 can be configured to fit on an upper portion 58 of a cup 50. For example, the intermediate member 560 can include a lower portion 562 adapted to snap onto or otherwise securely engage the rim or other upper portion 58 of the cup 50.

With continued reference to FIG. 15, a portion of the intermediate member's 560 sidewall has been hidden to illustrate the anti-splash device 570 positioned therein. As with other embodiments discussed herein, the anti-splash device 570 can include a plurality of openings 580. The openings 580 can be configured to allow fluids (e.g., a beverage, other liquids, air, other gases, etc.) to pass across the device 570. In addition, the openings 580 can help insulate a beverage or other item contained within the cup 50. Further, the anti-splash device 570 can be formed as a unitary body with the intermediate member 560. Alternatively, the anti-splash device 560 can be a separate member that is subsequently glued, sonic welded, pressure fitted and/or otherwise attached to the intermediate member 560.

As illustrated in FIG. 15, an upper portion 566 of the intermediate member 560 can be sized, shaped and otherwise adapted to receive a lid 500 or other closure member. As with the connection between the intermediate member 560 and the cup 50, the lid 500 can be configured to snap onto or otherwise securely engage the upper portion 566 of the intermediate member 560. Thus, the intermediate member 560 can provide the benefits of an anti-splash device without the need to position such a device within the interior of a cup.

Intermediate members 560 can be manufactured from paper, plastic, foam or other materials, as discussed herein with respect to the different embodiments of anti-splash devices. Further, intermediate members 560 can be configured to be disposable or reusable. In order to enhance the interface between intermediate members 560 and the adjacent portions of the cup 50 and lid 500, intermediate members 560 can be shaped and sized according to certain industry standards for cup openings, rim sizes and the like. In addition, it will be appreciated that an intermediate member 560 can have a different size, shape and general configuration than the embodiment illustrated in FIG. 15. For example, the intermediate member 560 can be taller or shorter than shown. In addition, the anti-splash device 570 can be connected to the intermediate member 560 at a higher or lower location.

Figure 16A:
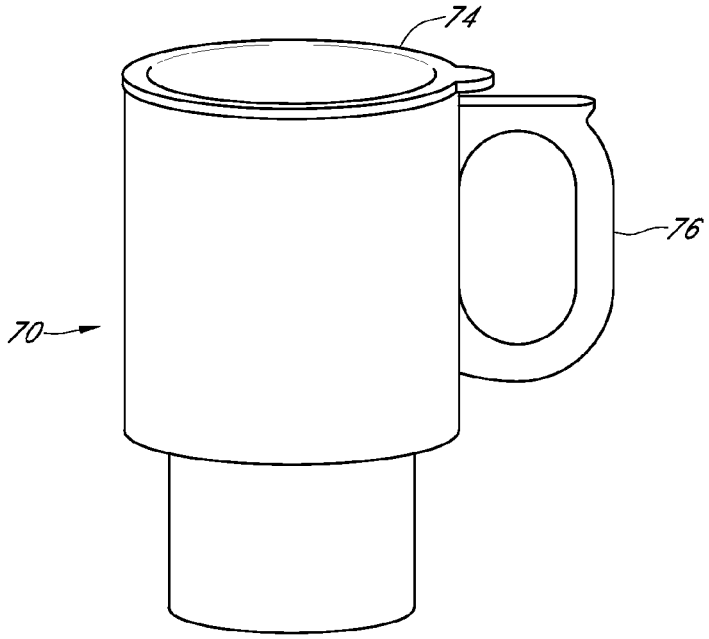
FIG. 16A is a perspective view of a travel mug according to one embodiment.
Figure 16B:
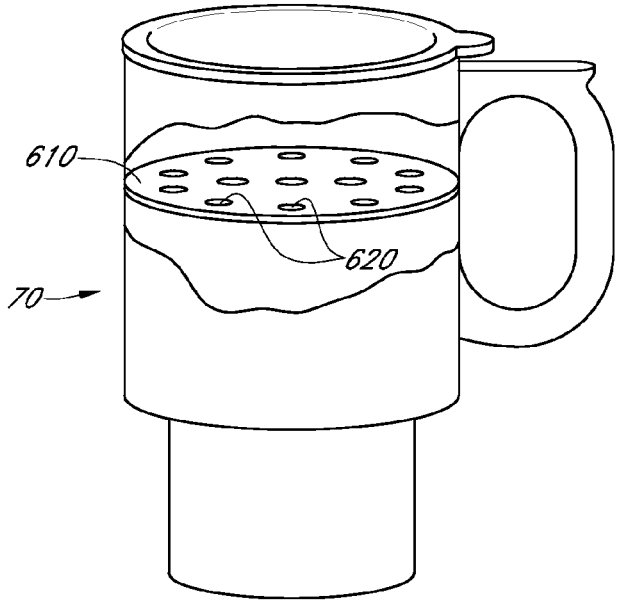
FIG. 16B is a perspective view of the travel mug of FIG. 16A with a portion of the mug wall hidden to reveal an anti-splash device positioned therein.

With reference to FIGS. 16A and 16B, an anti-splash device 610 can also be positioned within a travel mug 70 or other reusable container. As shown, the anti-splash device 610 can have a generally circular shape configured to substantially coincide with the inner wall of the mug 70. Any of the embodiments of the anti-spill devices discussed and/or illustrated herein can be applied to travel mugs 70 or other types of containers. For example, an anti-spill device 610 can be adapted to float on the surface of the beverage. Alternatively, the anti-spill device may be fixed along a portion of the interior wall of the mug 70. In other embodiments, the anti-splash device 610 can be attached, either permanently or temporarily, to the lid 74 of the mug 70. In yet other embodiments, the anti-splash device 610 can include a sealing portion along its periphery to more securely engage an interior wall of the mug 70. In some embodiments, the anti-spill device includes a resilient edge channel or other feature (FIGS. 23A, 25A) that is configured to engage the interior wall of the container. In such arrangements, at least a portion of the edge of the anti-splash device can be adapted to generally conform and/or take substantially the same shape as the interior wall portion of the travel mug or other container.

It will be appreciated that the anti-splash device 610 can have any planar and/or non-planar shape, such as, for example, convex, concave, domed, spherical, conical, fluted, wavy, curled, grooved, channeled, irregular-shaped and/or the like.

An anti-splash device can be positioned on one or more rails or other guides disposed on the interior of a cup or mug. These guides can allow a user to select the height or range of height at which the anti-spill device is located. Alternatively, such rails or guides can help ensure that the horizontal position of an anti-spill device does not change, regardless of whether the cup or container contains a beverage.

In other embodiments, an anti-splash device can be configured to permit a user to easily change the number and/or size of the openings disposed thereon. For example, the anti-splash device can comprise two complementary members (e.g., planar or non-planar discs or other members) that are capable of rotating relative to one another. As a user rotates the members relative to each other, the number of openings and/or their size can be advantageously varied in accordance with a user's preference.

In some embodiments, a cup can be manufactured together with one or more anti-splash devices. This applies to any of the anti-splash designs discussed and/or illustrated herein. For example, the anti-splash devices can be molded, cut or otherwise formed with the cup or other container.

As discussed and illustrated herein, the anti-splash device can have any generally planar and/or non-planar shape or configuration. Some non-limiting example of such shapes and configurations are illustrated in FIGS. 17A through 17D. For example, in FIG. 17A, the anti-splash device 710A includes a generally curved or dome shape. Likewise, in the embodiment depicted in FIG. 17B, the anti-splash device 710 includes a sharper curvature along its surface. Further, in FIGS. 17A and 17B, the illustrated anti-splash devices 710A, 710B are configured so that their middle portions are generally positioned above the respective edge portions of the devices. As shown, the middle portion in each of these embodiments extends above a horizontal line H drawn through the edges of the anti-splash devices 710A, 710B.

Figure 17A:
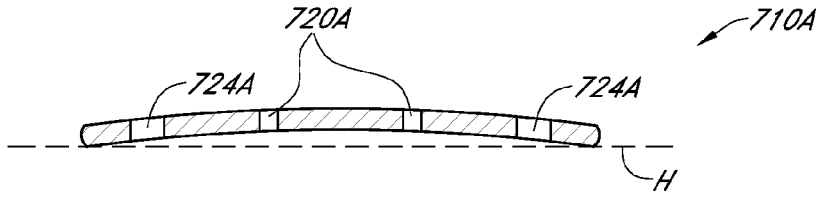
FIG. 17A is a cross-sectional view of an anti-splash device having a generally rounded shape according to one embodiment.
Figure 17B:
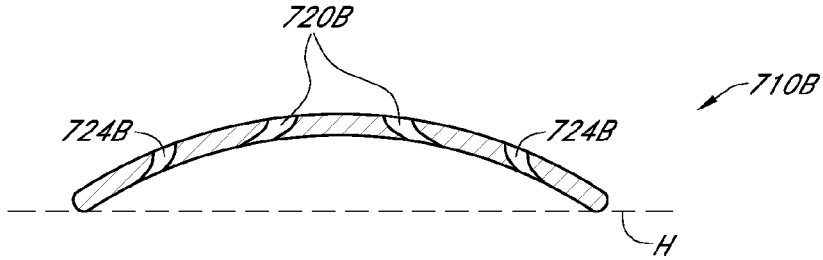
FIG. 17B is a cross-sectional view of an anti-splash device having a generally rounded shape according to another embodiment.
Figure 17C:
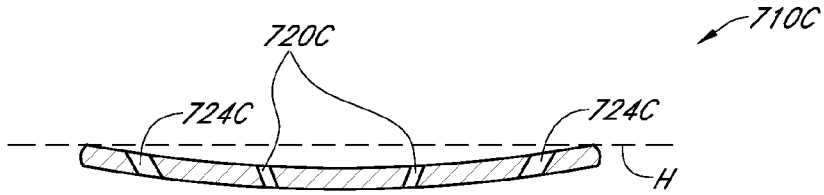
FIG. 17C is a cross-sectional view of an anti-splash device having a generally rounded shape according to yet another embodiment.
Figure 17D:
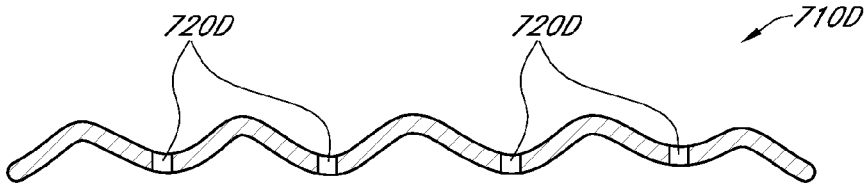
FIG. 17D is a cross-sectional view of an anti-splash device having a generally fluted or rippled shape according to one embodiment.

FIG. 17C illustrates an alternative embodiment of an anti-splash device 710C having a curved shape. As shown, a middle portion of the anti-splash device 710C extends generally below a horizontal line H which joins the edges. Thus, the anti-splash device 710C of FIG. 17C forms a recessed area towards the middle portion of its body. It will be appreciated that the shape, curvature and/or other details of the anti-splash device can be different than in the embodiments illustrated and described herein. For example, with reference to FIG. 17D, the anti-splash device 710D can include a rippled or fluted shape.

Regardless of their exact shape, size, dimensions and other characteristics, the anti-splash devices preferably include one or more openings 720A-D, 724A-D through which a beverage, air and/or other fluid may pass. As described herein, the size, shape, spacing, location and other details of the openings can vary as desired or required by a particular application or use.

Figure 18A:
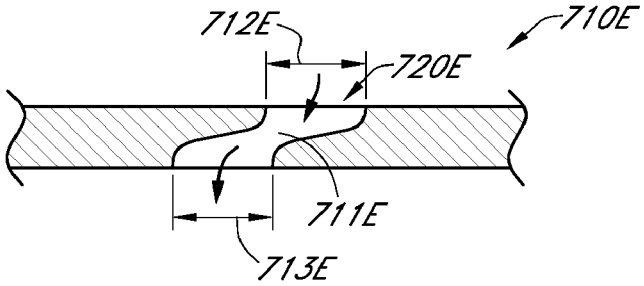
FIG. 18A is a cross-sectional view of an opening through an anti-splash device according to one embodiment.

FIG. 18A illustrates one embodiment of an opening 720E through an anti-splash device 710E. The depicted opening 720E is shaped and configured so that it begins and ends at different horizontal locations along the body of the device 710E. As shown, the opening 720E can be adapted so that there is some horizontal overlap between the upper location 712E and lower location 713E of the opening 720E. Therefore, the opening 720E can comprise a channel portion 711E that passes through an interior portion of the anti-splash device 710E. Such a channel portion 711E can facilitate in the thermal insulation of the contents situated below the anti-splash device 710E (e.g., coffee, tea, other hot beverage, etc.). The interior channel portion 711E can be configured to advantageously make it more difficult for heat to escape through the opening 720E. In addition, such openings 720E can help to further enhance the anti-splash features of an anti-splash device 710E.

Figure 18B:
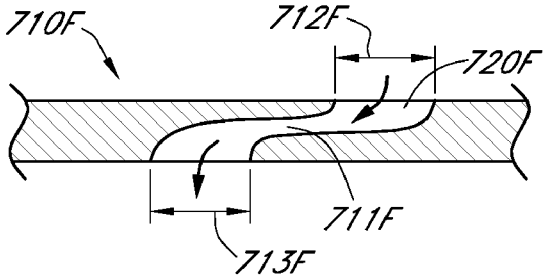
FIG. 18B is a cross-sectional view of an opening through an anti-splash device according to one embodiment.
Figure 18C:
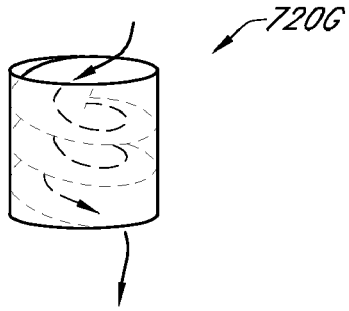
FIG. 18C is a perspective view of an opening through an anti-splash device according to another embodiment.

Alternative embodiments of such openings are illustrated in FIGS. 18B and 18C. In FIG. 18B, the channel portion 711F positioned within the interior of the anti-splash device 710F is generally longer than the channel portion illustrated in FIG. 18A. This further distances the upper and lower locations 712F, 713F of the opening 720F, which may further enhance the thermal insulation and/or anti-splash properties of the device 710F. FIG. 18C illustrates an opening 720G which includes a spiral or corkscrew shape through the depth of the anti-splash device. Therefore, the beverage, air or other fluid passing through the anti-splash device follows a generally tortuous path, as shown in FIG. 18C.

It will be appreciated that the various embodiments of openings illustrated and described herein, such as, for example, those discussed with reference to FIGS. 18A-18C, can be used in any type of anti-splash device.

Figure 19A:
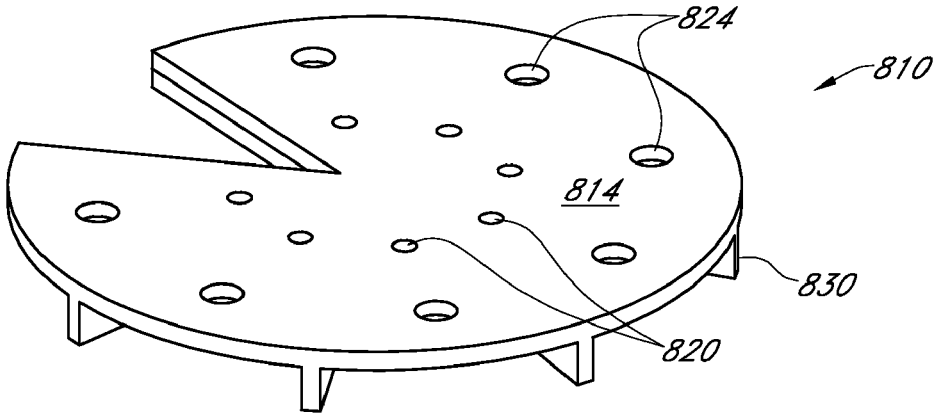
FIG. 19A is a perspective top view of an anti-splash device having a plurality of ribs along its bottom surface according to one embodiment.
Figure 19B:
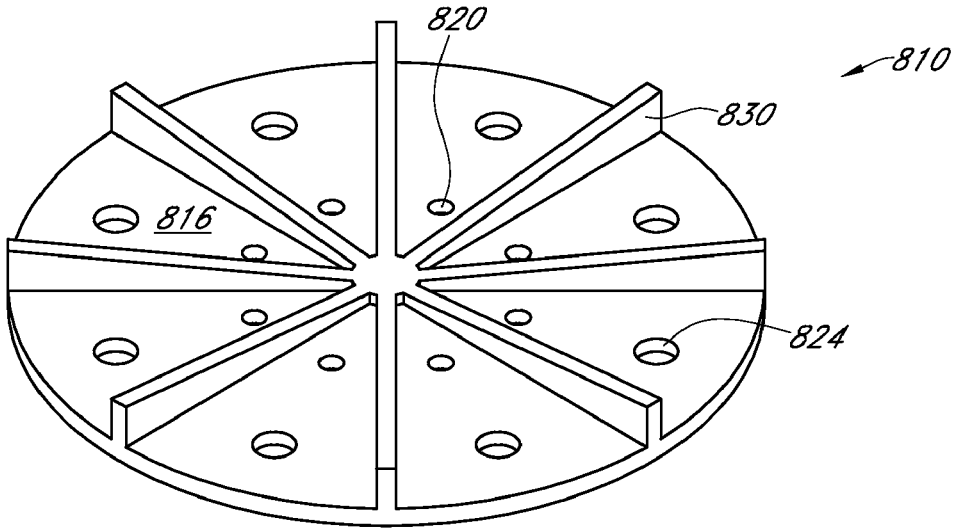
FIG. 19B is a perspective bottom view of the anti-splash device of FIG. 19A.

With reference to FIGS. 19A and 19B, an anti-splash device 810 can comprise one or more ribs 830, grooves and/or other members along one or more of its surfaces. In the illustrated embodiment, the ribs 830 are positioned along the bottom surface 816 of the anti-splash device 810. As shown, the ribs 830 are oriented in a generally radial pattern so that they generally extend toward the outer perimeter of the anti-splash device 810. In some embodiments, as illustrated in FIG. 19B, the ribs 830 can join to each other near the center of the anti-splash device 810. However, in alternative embodiments, the ribs 830 can include a non-radial configuration and may not be connected to each other. For example, in other arrangements, the ribs 830, grooves or other members can have a different orientation along one or both surfaces of the anti-splash device 810. For example, the general shape of the ribs 830 or grooves can be circular, concentric, irregular, random and/or the like. The ribs 830 or other support members can help stabilize the anti-splash device 810. For instance, the ribs 830 or similar members can help prevent the anti-splash device 810 from overturning or otherwise becoming misaligned within the interior of a cup when the device 810 is first positioned and/or during use.

With continued reference to FIG. 19B, the height, width and/or other dimension of the ribs 830 can vary along their length. In FIG. 19B, the height of the ribs 830 increases toward the radial exterior or the anti-splash device 810. Further, the depicted ribs 830 include a generally flat bottom surface and rectangular cross-section. However, it will be appreciated that the ribs 830 can have a different size, dimensions, shape (e.g., curved), spacing and/or other configuration than illustrated and discussed herein.

The ribs 830 or other support members can be formed from a unitary structure with the anti-splash device 810. For example, the anti-splash device 810 can be molded, cast, cut or otherwise formed (e.g., thermoformed) with one or more ribs 830. Alternatively, the ribs 830 and the anti-splash device 810 can be separate items that are joined using one or more attachment methods or devices (e.g., adhesives, sonic welds, etc.). In other embodiments, the ribs 830 are formed by depressing, deforming or otherwise shaping at least a portion of the anti-splash device 810 either during or after the manufacture of the anti-splash device. In some embodiments, an anti-splash device includes ribs 830 or other support members along its upper surface 814, either in lieu of or in addition to having ribs 830 or support members along its bottom surface 816. For example, in some arrangements, the same ribs or other support members are configured to affect the surface of both sides of an anti-splash device. It will be appreciated that the ribs 830, grooves and/or other members can be situated on any generally planar and/or non-planar anti-splash device discussed and/or illustrated herein, or variations thereof.

As illustrated in FIGS. 19A and 19B, the anti-splash device 810 can include a plurality of openings 820, 824. In some embodiments, the openings 820, 824 are advantageously positioned so as to not interfere with the ribs 830 or other support members situated along the surfaces of the anti-splash devices. However, it will be appreciated that one or more openings 820, 824 can be positioned through a rib 830 or other support member.

Figure 20A:
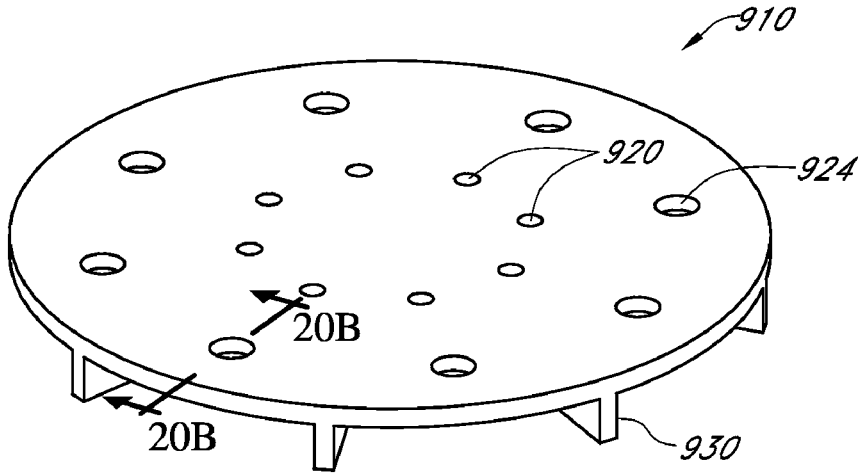
FIG. 20A is a perspective view of an anti-splash device according to another embodiment.

FIG. 20A illustrates another embodiment of an anti-splash device 910 that comprises a plurality of enlarged portions 930 along its perimeter. As depicted in the cross-sectional view of FIG. 20B, the enlarged portions 930 can be configured to include an interior cavity portion 932 which is in fluid communication with a top opening 924 and bottom opening 936. Consequently, the interior cavity portion 932 can receive liquid, air and/or other fluid either from above or below the anti-splash device 910 and discharge it to the opposite side of the anti-splash device 910. In addition, the enlarged portions 930 can be configured to provide stability to the anti-splash device 910, helping to ensure that the device 910 does not overturn or otherwise undesirably reposition itself within a cup or other beverage container. Such enlarged portions 930 can be included in any of the embodiments of anti-splash devices discussed and/or illustrated herein.

Figure 20B:
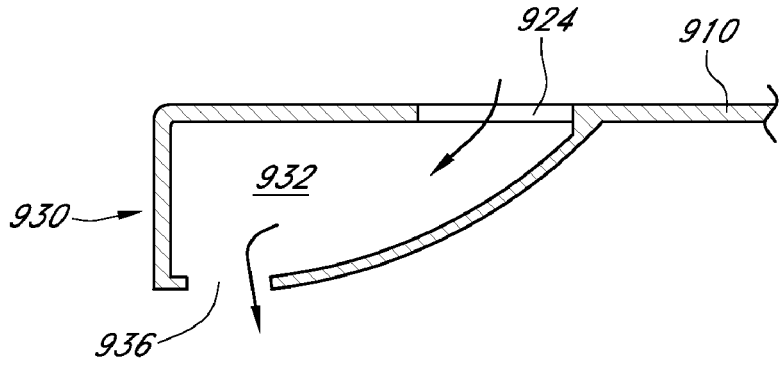
FIG. 20B is a cross-sectional view of a side of the anti-splash device of FIG. 20A, taken along line 20B-20B of FIG. 20A.

With continued reference to FIGS. 20A and 20B, the enlarged portions 930 can be manufactured as a unitary structure with the anti-splash device 910. In alternative embodiments, however, the enlarged portions 930 and the anti-splash device 910 can be separate items that are joined to each other using one or more attachment devices or methods (e.g., adhesives, sonic welding, etc.). Further, it will be appreciated that the number, size, dimensions, spacing, location, shape and/or other characteristics of the enlarged portions 930 can be different than illustrated and discussed herein. For example, the enlarged portions 930 can extend along a greater portion of the surface of the anti-splash device 910. In addition, the enlarged portion 930 can affect the shape of the upper surface of the anti-splash device. In other embodiments, the interior cavity portion 932 of the enlarged portion 930 can be in fluid communication with two or more upper openings 920, 924 and/or lower openings 936.

Figure 21A:
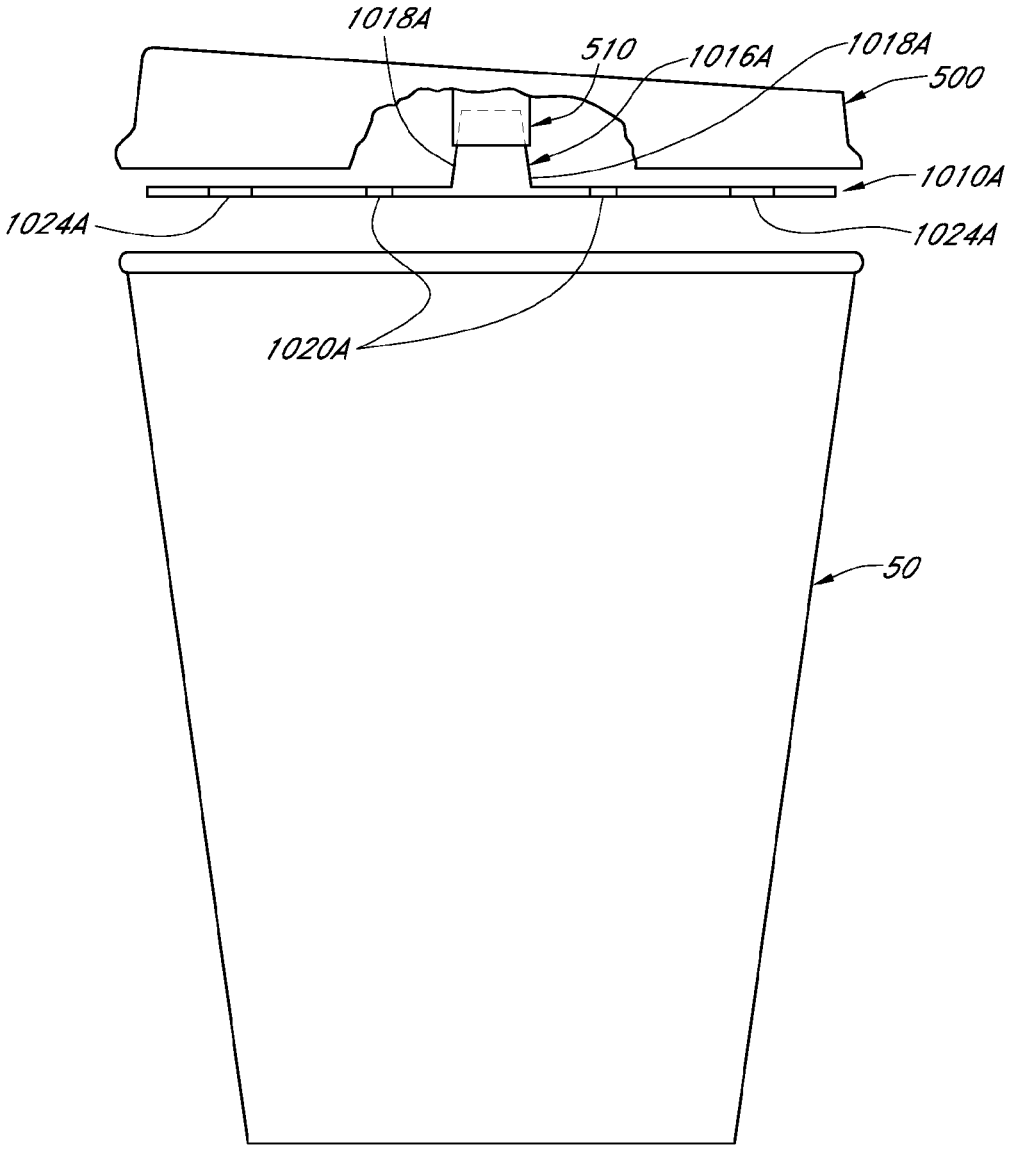
FIG. 21A is a side elevation view of an anti-splash device attached to a cup lid according to one embodiment.

FIG. 21A illustrates one embodiment of an anti-splash device 1010A that is attached to a lid 500 or other closure member of a cup 50. As shown, the anti-splash device 1010A includes a connecting member 1016A which extends from the upper surface of the anti-splash device 1010A. In the illustrated embodiment, the connecting member 1016A includes a generally cylindrical shape and is positioned approximately at the center of the anti-splash device 1010A. However, in other embodiments, the connecting member 1016A can have any other shape and can be attached to the anti-splash device 1010A at locations other than the center. In yet other embodiments, an anti-splash device 1010A includes two or more different connecting members 1016A for attachment to the lid 500.

With continued reference to FIG. 21A, the connecting member 1016A can be manufactured as a unitary member with the anti-splash device 1010A. For example, the anti-splash device 1010A can be molded, cast or otherwise formed (e.g., thermoformed) together with one or more connecting members 1016A. Alternatively, the anti-splash device 1010A and the connecting members 1016A can be separate items which are joined using one or more attachment methods or devices, such as, for example, adhesives, sonic welding, fasteners, friction fittings, snap fittings and/or the like.

As illustrated in FIG. 21A, the lid 500 can comprise one or more receiving members 510 which are sized, positioned and/or otherwise configured to receive one or more corresponding connecting members 1016A of the anti-splash device 1010A. The lid 500 can be formed with one or more receiving members 510. Alternatively, the lid 500 and the receiving members 510 can be separate items which can be joined to each other before the lid 500 is used. In some embodiments, the receiving member 510 comprises the female half of a female-male coupling. For example, the receiving member 510 can include a hollow interior cavity portion into which the connecting member 1016A can be securely inserted. According to some embodiments, the connecting member 1016A is simply press-fit or friction-fit into the receiving member 510 of the lid 500.

In some embodiments, as depicted in FIG. 21A, the connecting member 1016A can include sloped side walls 1018A to facilitate insertion of the connecting member 1016A into the receiving member 510 of the lid 500.

It will be appreciated that other types of connections can be used to join a lid 500 to an anti-splash device 1010A. For example, the connecting member 1016A can comprise the female half of a fitting which attaches to a male half on the lid 500. In other embodiments, other types of connections can be used to join the lid 500 and the anti-splash device 1010A, such as, for example, fasteners, snap-fittings, adhesives, sonic welds and/or the like. In fact, in some embodiments, the lid 500 and the anti-splash device 1010A can be manufactured as a unitary item. Consequently, the anti-splash device 1010A and the lid 500 can be removably or permanently attached to each other, as desired or required by a particular application.

In embodiments where the anti-splash device 1010A and the connecting member 1016A are separate items, one or more additional securement devices or methods can be used to ensure that the anti-splash device 1010A and the connecting member 1016A do not unintentionally detach from one another. For example, one or more adhesives, pins, fasteners, sonic welds, tabs and/or other attachment devices or methods can be used.

Once the anti-splash device 100A has been attached to the lid 500, the lid 500 can be placed over the brim of the cup 50. As described herein with respect to other embodiments, the anti-splash device 1010A can preferably include a plurality of openings 1020, 1024 through which one or more fluids may pass. The anti-splash device 1010A can advantageously reduce the likelihood that liquid contained with the cup 50 undesirably splashes or is otherwise directed toward the user. It will be appreciated that the shape, size, thickness, other dimensions, location relative to the lid 500 and/or the brim of the cup 50, materials of construction and other properties of the anti-splash device 1010A can vary. For example, the anti-splash device 1010A can have a planar, non-planar, domed (e.g., convex, concave, etc.), conical, fluted, grooved or any other shape.

The anti-splash device 1010A, the one or more connecting members 1016A and the lid 500 can be manufactured from the same or different materials. For example, in one embodiment, the anti-splash device 100A, the one or more connecting members 1016A and the lid 500 are manufactured from polymeric, thermoplastic (e.g., polystyrene), paper-based materials and/or the like.

As with all other embodiments discussed and illustrated herein, the position of the anti-splash device 1010A relative to the lid 500 and/or the brim of the cup 50 can vary. For instance, in some embodiments, it is desirable for the anti-splash device 1010A to be situated near the brim of the cup 50. This can facilitate use of the anti-splash device 1010A even if the internal contents (e.g., beverage, other foodstuff, etc.) of the cup 50 are relatively close to the brim. For example, it may be desirable to position the anti-splash device 1010A closer to the lid 500 if the cup 50 will contain whip cream, foam or the like. In some embodiments, the vertical location of the anti-splash device 1010A can be aligned with the brim of the cup 50. In other embodiments, however, the anti-splash device 1010A can be positioned above or below the brim of the cup as desired or required by a particular application or use. For example, the anti-splash device 1010A can be located within the recessed area of the lid 500. In other arrangements, the anti-splash device 1010A can be located below the brim of the cup 50. For non-planar embodiments of the anti-splash device 1010A, some portions of the anti-splash device 1010A may be positioned at or above the cup's brim while other portions may be positioned at or below the cup's brim.

According to some embodiments, the anti-splash device 1010A, when attached to the lid 500, is positioned at generally the same vertical orientation as the brim of the cup. In other embodiments, the anti-splash device 1010A, when attached to the lid 500, is approximately ⅛-inch below the brim of the cup. However, it will be appreciated that in other arrangements, the anti-splash device 1010A can be located higher or lower than ⅛-inch below the brim of the cup.

In addition, according to some embodiments, the connecting member 1016A comprises a hollow cylindrical shape having an approximate diameter to ½ to ¾ inches. In other embodiments, however, the connecting member 1016A can be non-hollow, can have a non-cylindrical shape and/or can have a diameter (or other comparable dimension) which is larger or smaller than ½ to ¾ inches.

Figure 21B:
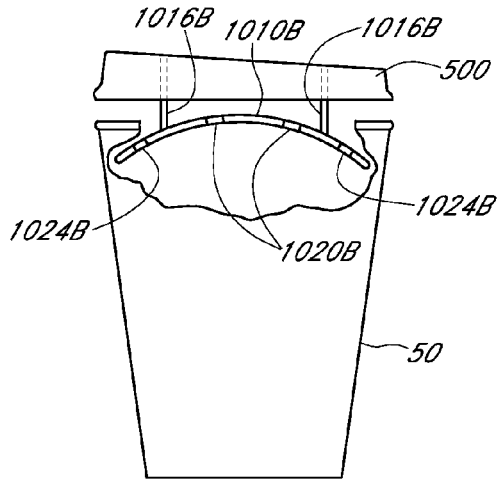
FIG. 21B is a side elevation view of an anti-splash device attached to a cup lid according to another embodiment.

FIG. 21B illustrates another embodiment of an anti-splash device 1010B that is attached to a lid 500 of a cup 50. In the depicted embodiment, the anti-splash device 1010B is attached to the lid 500 using two connecting members 1016B. However, it will be appreciated that fewer or more connecting members 1016B can be used to attach an anti-splash device 1010B to a lid 500. According to some arrangements, the connecting members 1016B comprise one or more rigid or semi-rigid materials, such as, for example, thermoplastics, paper-based materials, other synthetic or natural materials and/or the like.

With continued reference to FIG. 21B, the anti-splash device 1010B comprises a generally concave shape, so that the middle portion of the anti-splash device 1010B is situated above the edges. In other embodiments, however, the anti-splash device 1010B can have any other shape, such as, for example, convex, planar, non-planar, domed, grooved, fluted, irregular, conical, saw-tooth and/or the like.

In FIG. 21B, the connecting members 1016B attach to the anti-splash device 1010B at generally opposite ends of each other to improve stability. In other embodiments, the connecting members 1016B can attach to the anti-splash device 1010B at one or more other places, either more or less proximate to the edge of the anti-splash device 1010B. Likewise, the exact location at which the connecting members 1016B attach to the lid 500 can also vary. The connecting members 1016B can be joined to the anti-splash device 1010B and/or the lid 500 using one or more temporary or permanent attachment devices or methods, such as, for example, adhesives, fasteners, sonic welds, other types of welds, snap-fit connections and/or the like. In other embodiments, the anti-splash device 1010B and/or the lid 500 can be formed from the same unitary structure as the connecting methods 1016B (e.g., molded, thermoformed, cut-out, cast, etc.).

With continued reference to the embodiment illustrated in FIG. 21B, the anti-splash device 1010B can comprise a plurality of openings 1020B, 1024B as discussed and shown herein with respect to other embodiments. The size, shape, location, spacing and other details regarding the openings

1020B, 1024B can vary. Further, the size, shape, thickness, other dimensions, spacing from the adjacent interior walls of the cup and/or other properties of the anti-splash device 1010B can vary as desired or required by a particular application or use. For example, in the depicted embodiment, there is a relatively small gap between the outer periphery of the anti-splash device 1010B and the interior wall of the cup 50. However, in other arrangements, the outer edge of the anti-splash device 1010B can contact the adjacent interior wall of the cup 50. In yet other embodiments, the gap between the anti-splash device 1010B and the cup interior can be greater than shown in FIG. 21B.

According to some embodiments, the anti-splash device 1010B, the connecting members 1016B and/or the lid 500 can be permanently or removably attached to one another. For example, the anti-splash device 1010B, the connecting members 1016B and the lid 500 can be securely joined to each other so that they cannot be easily separated during use. However, in other arrangements, one or more of the separate components can be detachable and/or attachable to facilitate disposal, transport, storage and/or other procedures or activities.

Figure 21C:
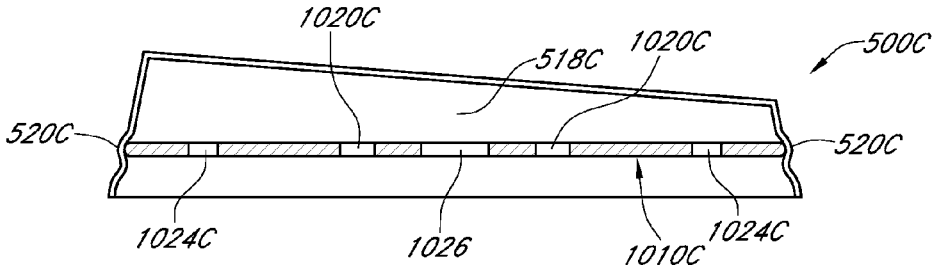
FIG. 21C is a cross-sectional view of an anti-splash device directly attached to a cup lid according to one embodiment.

In the cross-sectional view of the embodiment illustrated in FIG. 21C, an anti-splash device 1010C is secured within a recessed area 518C of a lid 500C. As shown, the anti-splash device 1010C and the lid 500C are sized, shaped and otherwise configured so that the anti-splash device 1010C snap fits into an annular lip 520C of the lid 500C. In the illustrated embodiment, the anti-splash device 1010C comprises a center opening 1026 which assists a user to manipulate the anti-splash device 1010C into and out of the recessed area 518C of the lid 500C. It will be appreciated that one or more other methods and/or devices of attaching an anti-splash device to a lid can also be used, either in lieu of or in addition to attachment methods and devices disclosed herein.

It will be appreciated that the various methods, devices and other features or characteristics of attaching an anti-splash device to a lid or other portion of a container, including those discussed in reference to FIGS. 21A through 21C, can be used for any of the embodiments of the anti-splash devices described and illustrated herein, or variations thereof.

Figure 22A:
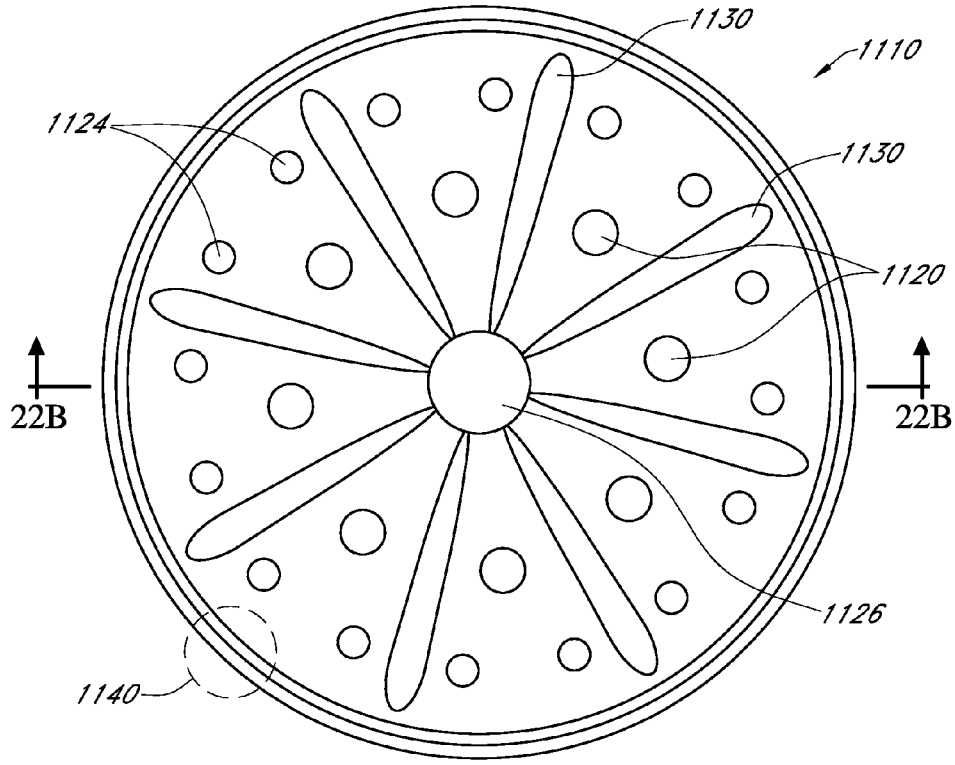
FIG. 22A is a top view of an anti-splash device according to yet another embodiment.
Figure 22B:
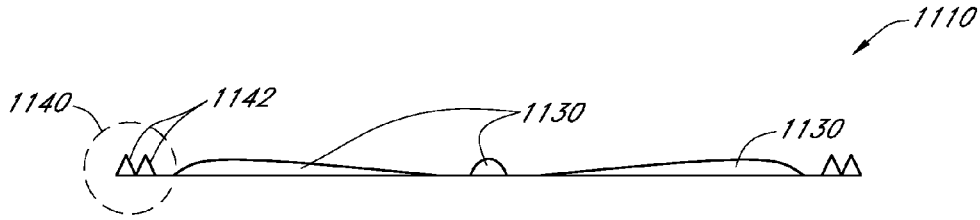
FIG. 22B is a cross-sectional view of the anti-splash device of FIG. 22A.

FIGS. 22A and 22B illustrate another embodiment of an anti-splash device 1110 configured for placement within a cup or other beverage container. The depicted anti-splash device 1110 comprises a plurality of ribs 1130 or spines situated along its upper surface. It will appreciated, however, that the anti-splash device 1110 can comprise one or more ribs or other members along its lower surface, either in lieu of or in addition to the ribs 1130 positioned along the upper surface. As discussed herein with respect to other embodiments, the ribs 1130 or other members can help stabilize the anti-splash device 1110 within a cup so that the anti-splash device does not overturn or otherwise move undesirably during use. The ribs 1130 or similar members can also provide aesthetic value, fluid flow or channeling benefits and/or the like to the anti-splash device 1110. The quantity, size, dimensions, shape, spacing, orientation relative to the anti-splash device 1110, method of connection to the anti-splash device 1110 and/or other details regarding the ribs 1130 or other members can vary as desired or required by a particular application or use. For example, the ribs 1130 or other members can be integrally formed (e.g., molded, cast, thermoformed, stamped into, etc.) with the anti-splash device 1110 or they can be separate members which are subsequently joined to the anti-splash device 1110 using one or more attachment devices or methods.

In other embodiments, the ribs 1130 or other members can be formed by impressing or otherwise deforming the shape of the anti-splash device 1110. This can create raised ribs 1130 on one side of the anti-splash device 1110 and corresponding grooves or recessed areas on the opposite side. As shown, the ribs 1130, grooves or other members positioned on one or both sides of the anti-splash device 1110 can have a generally radial orientation. However, in other embodiments, the ribs 1130, grooves or other members can have a different orientation along one or both surfaces of the anti-splash device (e.g., circumferential, other non-radial, random, etc.). For example, the general shape of the ribs 1130 or grooves can be circular, concentric, irregular, random or the like. It will be appreciated that such ribs or grooves can be included on any embodiment of an anti-splash device disclosed and/or illustrated herein. In addition, any of the anti-splash embodiments disclosed herein can include one or more features or characteristics of other embodiments.

With continued reference to FIG. 22A, openings 1120, 1124 in the anti-splash device 1110 can be positioned between adjacent ribs 1130, grooves or other members. In the embodiment illustrated in FIG. 22B, the openings 1120, 1124 are spaced and located according to an orderly pattern. In other embodiments, however, the orientation of the openings can be more or less random. In addition, the quantity, size, spacing, location, shape and other characteristics of the openings 1120, 1124 can be different than illustrated herein.

In FIG. 22A, the depicted anti-splash device 1110 comprises a central opening 1126. In some embodiments, such an opening 1126 can facilitate a user to position the anti-splash device 1110 into or out of a cup. For example, the opening 1126 can be configured so that a user can place his or her finger(s) through it to manipulate the position of the anti-splash device 1110 relative to a cup interior. Such an opening 1126 can have a different location, shape, size and/or other characteristics than the one illustrated in FIG. 22A. In addition, an anti-splash device 1110 can include two or more such openings 1126 to further facilitate the handling and positioning of the device. In other arrangements, as discussed with reference to the embodiment illustrated in FIG. 25A, an anti-splash device can comprise one or more handles or other gripping devices that can help a user to selectively manipulate the device into and/or out of a cup or other container. It will be appreciated that such openings and/or handles that assist in the handling of an anti-splash device can be used with any of the embodiments discussed and/or illustrated herein.

As shown in FIGS. 22A and 22B, the anti-splash device 1110 can comprise a deformable peripheral edge 1140. Such an edge 1140 can help secure the anti-splash device 1110 to the interior of a cup. Moreover, the deformable peripheral edge 1140 can help provide a complete or partial seal between the anti-splash device 1110 and the interior wall of a cup. In the illustrated embodiment, the peripheral edge 1140 is generally continuous around the entire circumference of the anti-splash device 1110. In other embodiments, however, the edge 1140 can be intermittently positioned around the outer portion of the device 1110.

With continued reference to FIGS. 22A and 22B, the deformable peripheral edge 1140 can be formed by shaping the outer portion of the anti-splash device 1110 into a folded or accordion-like pattern. Thus, the adjacent folds 1142 of the edge 1140 can stretch or compress as the anti-splash device 1110 encounters frictional resistance from an adjacent surface (e.g., interior wall of a cup). This can help a user securely position the anti-splash device 1110 within the interior of a cup. In addition, in some embodiments, the deformable peripheral edge 1140 can form a partial or complete seal between the anti-splash device 1110 and the interior walls of a beverage container. As discussed and/or illustrated herein with respect to other embodiments, the edge of an anti-splash device can have a different configuration. For example, an anti-splash device may not have a deformable peripheral edge. Instead, the anti-splash device can be configured to not engage the adjacent surface of the cup interior. In other embodiments, as discussed with reference to the embodiments of FIGS. 23A and 25A, a deformable peripheral edge can have a different shape, size, design and/or configuration.

Figure 23A:
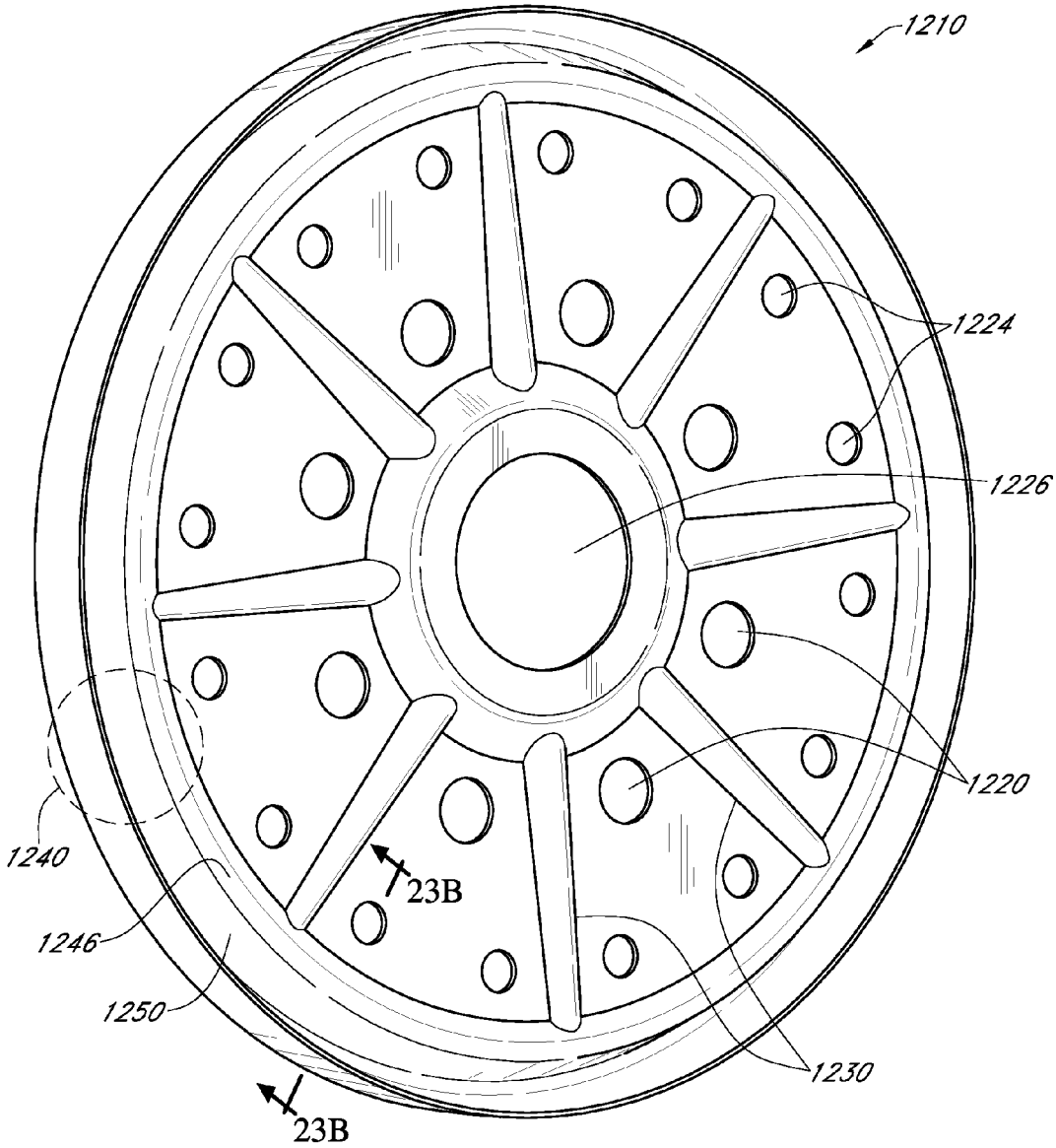
FIG. 23A is a perspective view of an anti-splash device according to another embodiment.

FIG. 23A illustrates an anti-splash device 1210 which is similar to the embodiment discussed herein in relation to FIGS. 22A and 22B. As shown, the anti-splash device 1210 includes a plurality of radially-oriented ribs 1230, grooves or other members positioned along one or both of its surfaces. Further, a plurality of openings 1220, 1224 configured to permit a beverage, air and/or other fluids to pass therethrough can be positioned along the surface of the anti-splash device 1210. The anti-splash device 1210 can also include a center opening 1226, handle or other feature which facilitates the manipulation of the anti-splash device 1210, especially when it is being inserted into or removed from the interior of a cup.

Figure 23B:
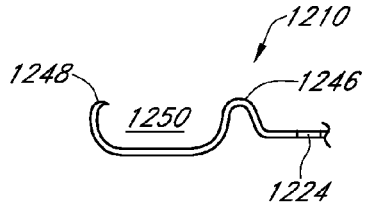
FIG. 23B is a partial cross-sectional view of the edge of the anti-splash device of FIG. 23A.

The anti-splash device 1210 can include a deformable peripheral edge 1240 for securing and/or sealing the anti-splash device 1210 within an interior of a cup. As illustrated in the cross-sectional view of FIG. 23B, the outer portion of the anti-splash device 1210 can be shaped so as to form one or more channels 1250 or grooves. In FIGS. 23A and 23B, the channel 1250 is defined by a curled outer end 1248 and an interior ridge 1246. The channel 1250 can be formed at the time the anti-splash device is being molded, cast, thermoformed or otherwise manufactured. Alternatively, the channel 1250 can be produced by shaping the anti-splash device after the anti-splash device has been produced. In yet other embodiments, the deformable peripheral edge 1240 can be a separate member which is attached to the anti-splash device 1210 using one or more connection methods or devices. The deformable peripheral edge 1240 can be continuous around the entire outer portion of the anti-splash device 1210. Alternatively, the deformable peripheral edge 1240 can be intermittently located along the outer portion of the anti-splash device 1210.

In use, as the anti-splash device 1210 is being lowered into a cup, the deformable peripheral edge 1240 contacts the interior walls of the cup. If a user continues to move the anti-splash device 1210 deeper into the interior of the cup, the curled outer end 1248 of the deformable peripheral edge 1240 will move towards the interior ridge 1246, thereby at least partially collapsing the annular channel 1250. This can help secure the anti-splash device along the interior of the cup and/or form a partial or complete seal between the anti-splash device 1210 and the interior walls of the cup. In some embodiments, this will cause at least a portion of the deformable peripheral edge 1240 to contact an interior wall of the cup or other container, thereby causing such a portion of the peripheral edge 1240 to generally match the shape of the adjacent surface of the cup's interior wall. Thus, in certain embodiments, if an anti-splash device is pushed far enough into a cup interior, the deformable peripheral edge can form a partial or complete seal with the adjacent portions of the cup's interior wall. It will be appreciated that such a deformable peripheral edge can be included in any of the embodiments of the anti-splash devices described and/or illustrated herein.

As discussed herein, according to some embodiments, the anti-splash device 1210 can be manufactured using thermoforming, casting, vacuum forming, molding and/or any other type of production method. In addition, the anti-splash device 1210 can be manufactured from one or more natural or synthetic materials, such as, for example, polymeric materials, thermoplastics, paper-based materials, films, foams and/or the like.

Figure 24:
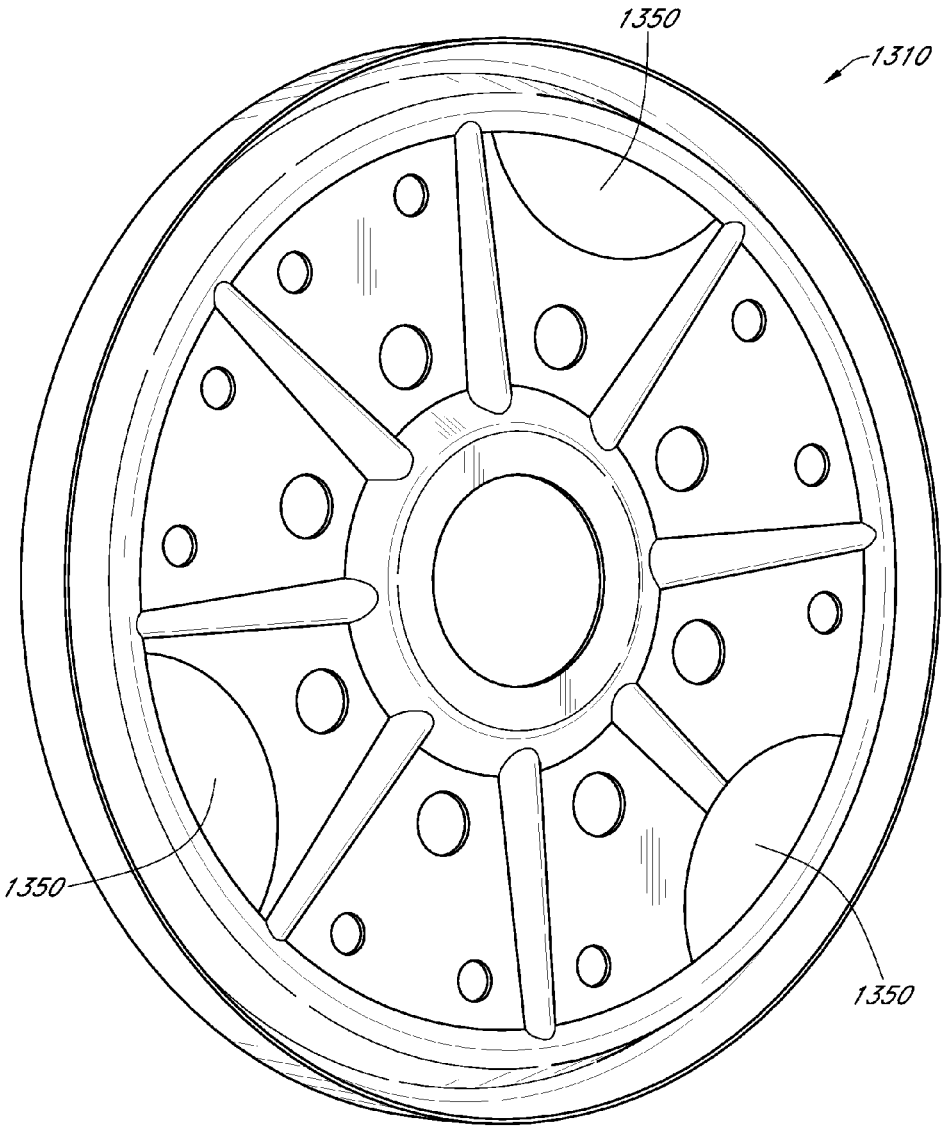
FIG. 24 is a perspective view of an anti-splash device comprising a plurality of finger guides according to one embodiment.

FIG. 24 illustrates one embodiment of an anti-splash device 1310 comprising three finger guides 1350 near its outer portions. As shown, the finger guides 1350 are generally equally-spaced from each other. However, it will be appreciated that in other embodiments, that an anti-splash device can include more or fewer finger guides 1350, and the location, size, shape, dimensions, spacing and other details regarding the finger guides 1350 can be different than shown and illustrated herein.

With continued reference to FIG. 24, the finger guides 1350 provide targeted points of contact on which a user may push or exert one or more other forces, stresses, moments and/or the like while positioning an anti-splash device within or onto a cup or other container. In some embodiments, the finger guides 1350 are identical or similar to the adjacent portions of the anti-splash device 1350. For example, the area comprising a finger guide 1350 can be constructed from the same material, can have the same thickness and/or one or more other characteristics of the adjacent portions of the anti-splash device 1310. Alternatively, the finger guides 1350 can have a different thickness, shape, materials of construction, surface features or texture and/or other characteristics than the adjacent portions of the anti-splash device 1310.

In some embodiments, the finger guides 1350 can be raised or depressed relative to the adjacent portions of the anti-splash device 1310. In other embodiments, the finger guides 1350 can have enhanced structural properties relative to one or more other portions of the anti-splash device 1310. For example, a finger guide 1350 can be thicker, manufactured from stronger or more durable materials and/or the like. In other embodiments, the finger guides 1350 can include reinforcing features, such as, for example, structural members, trusses and/or the like.

In some embodiments, the finger guides 1350 can comprise a unique surface texture that facilitates a user in realizing that he or she should exert a force primarily at those locations. In other embodiments, the finger guides 1350 and/or other portions of the anti-splash device 1310 can include text, an image or other indicia that provides instructions, such as, for example, "PUSH HERE" text. Such instruction indicators can be located on or near a surface of an anti-splash device. Alternatively, such instructions can be located on or near a surface of a cup, cup lid and/or the like.

According to some embodiments, the finger guides 1350 reduce the undesirable contact of a user with one or more other portions of an anti-splash device 1310. For example, a beverage seller or buyer can position the anti-splash device 1310 within a desired location of a cup, lid or the like, without unnecessarily touching or contacting portions of the anti-splash device 1310 other than the finger guides 1350. This can provide an improved hygienic environment. For instance, someone handling the anti-splash device will be encouraged to avoid contact with certain portions of the anti-splash device 1310 when positioning it within a cup, lid and/or the like. In addition, the inclusion of finger guides 1350 can help ensure that the anti-splash device 1310 is positioned correctly within the cup (e.g., right-side-up) and/or that the device 1310 is not damaged during the exertion of pushing, pulling and/or other forces and stresses.

It will be appreciated that one or more finger guides or similar devices can be included on any of the embodiments of an anti-splash device discussed herein.

FIGS. 25A through 25F illustrate another embodiment of an anti-splash device 1410 configured for placement within a cup or other beverage container. The depicted anti-splash device 1410 is similar to the embodiment illustrated and described with reference to FIG. 23A. As shown, the anti-splash device 1410 can have a generally circular shape. According to some embodiments, the outer diameter of the device 1410 is approximately 3.2 inches. However, it will be appreciated that the shape, diameter, other dimensions and/or other characteristics of the anti-splash device 1410 can be different than illustrated and discussed herein. For example, the diameter of the device 1410 can be greater or smaller than 3.2 inches as desired or required by a particular application or use.

With continued reference to FIGS. 25A-25F, the depicted anti-splash device 1410 can include a plurality of openings 1420, 1424, ribs 1430 and/or other members or features along one or more of its surfaces. In addition, the anti-splash device 1410 can advantageously include a handle 1460 or similar grasping member. Such a handle 1460 or grasping member can help a user manipulate (e.g., position, re-position, remove, etc.) the anti-splash device relative to a cup interior. In the illustrated embodiment, the anti-splash device comprises a single handle 1460 located at or near its center. However, in other arrangements, the quantity, location, size, shape and/or other details of the handle 1460 or other grasping member can vary. In some embodiments, an anti-splash device 1410 can include an aperture or other opening (see FIG. 23A) that can be used to manipulate the device 1410, either in lieu of or in addition to a handle or other grasping member.

As shown in FIG. 25A, the handle 1460 can comprise a top ridge 1464 and adjacent side surfaces 1466. In some embodiments, as illustrated in FIG. 25A, the side surfaces 1466 can include ridges, texture and/or one or more other features. Such ridges or other features can improve a user's grasp of the handle 1460 and/or help to further enhance the aesthetics of the device 1410. As with other embodiments discussed and illustrated herein, the anti-splash device 1410 can be manufactured using one or more methods, such as, for example, molding, casting, thermoforming, other forming methods and/or the like.

Further, the anti-splash device 1410 can comprise one or more synthetic and/or natural materials, such as, for example, thermoplastics (e.g., polystyrene), paper products, foam and/or the like. The handle 1464, ribs 1430, outer peripheral edge and/or one or more other components of the anti-splash device 1410 can be manufactured as a single member or two or more members that are subsequently joined to each other. In addition, as with other embodiments disclosed herein, the illustrated anti-splash device 1410 can comprise a single layer of plastic or other material throughout its entire surface. Alternatively, in other embodiments, the anti-splash device 1410 comprises two or more layers of plastic or other materials, along all or some of its surfaces.

Figure 25D:
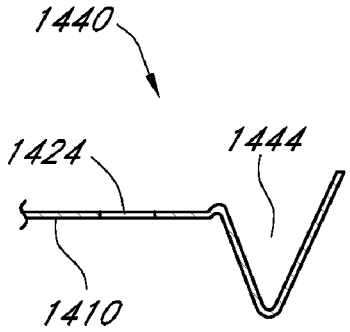
FIG. 25D is a partial cross-sectional view of the edge of the anti-splash device of FIG. 25A.
Figure 25E:
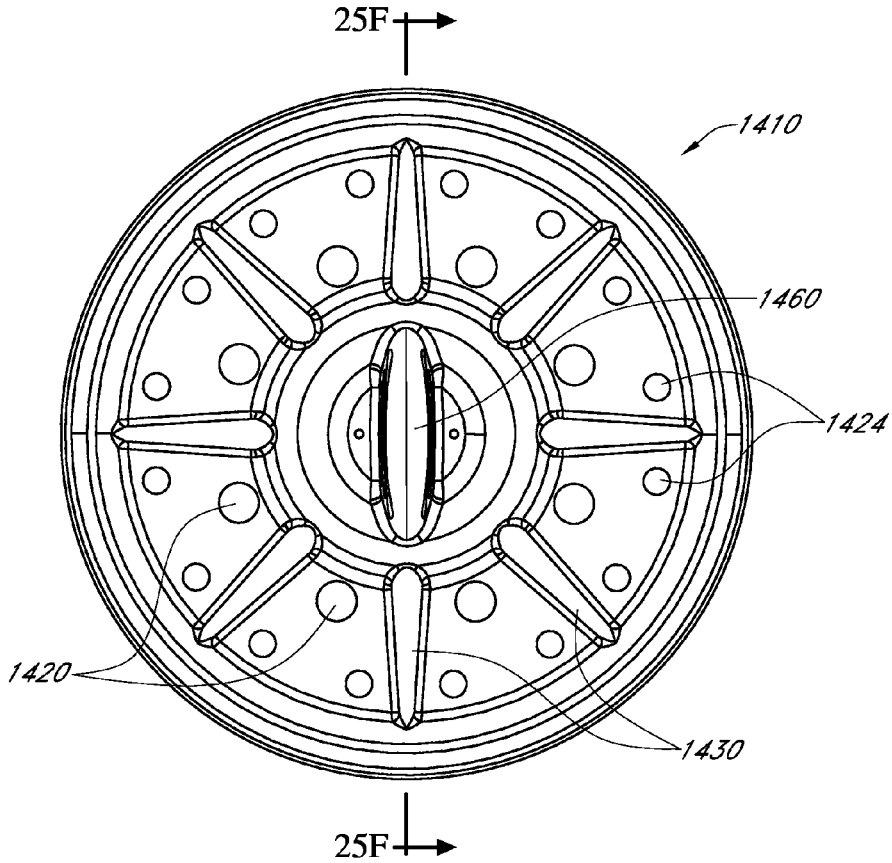
FIG. 25E is a top view of the anti-splash device of FIG. 25A.
Figure 25F:
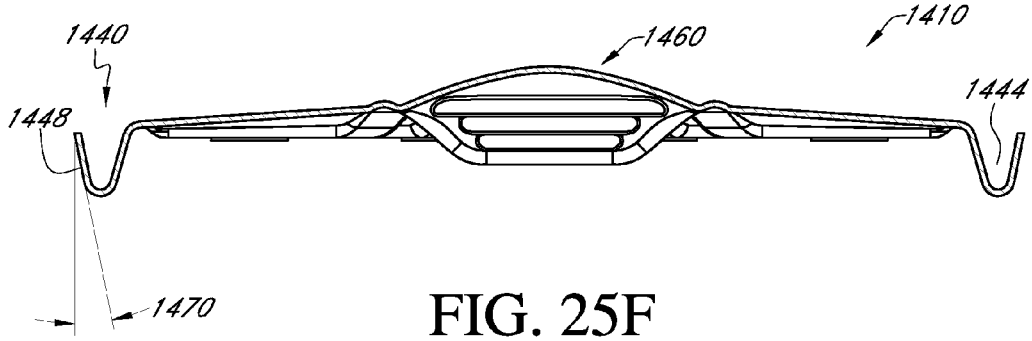
FIG. 25F is a cross-sectional view of the anti-splash device of FIG. 25A.

With reference to the cross-sectional views of FIGS. 25D and 25F, the anti-splash device 1410 can include a deformable peripheral edge 1440 that is sized, shaped and otherwise configured to engage an interior wall portion of a cup or other container. As with other embodiments described and/or illustrated herein, the deformable peripheral edge 1440 can be continuous around the entire circumference of the anti-splash device 1410. Alternatively, the peripheral edge 1440 can be intermittently located along selected sections of the device's circumference.

With continued reference to FIGS. 25D and 25F, the deformable peripheral edge 1440 comprises a generally U-shaped or V-shaped channel, which defines an interior space 1444. As the anti-splash device 1410 is moved into and/or out of a cup, the peripheral edge 1440 can be configured to contact or otherwise engage one or more portions of the cup's interior walls. For example, the internal diameter of a cup that includes a draft angle generally decreases with increasing depth. Thus, as the anti-splash device 1410 is lowered into a cup, the deformable peripheral edge 1440 may contact the cup's interior wall. With continued urging deeper into the interior of the cup, the peripheral edge 1440 can begin to deform. For example, the effective diameter of the anti-splash device 1410 may decrease as the circumferential edge of the device 1410 begins to move inwardly. Consequently, in some embodiments, the interior space 1444 defined by the peripheral edge 1440 may shrink relative to its uncompressed, normal state.

In some embodiments, the outer peripheral edge 1440 of the anti-splash device 1410 can comprise one or more resilient materials or configurations. This can help create an enhanced seal between the anti-splash device 1410 and the cup or other container, as the resiliency can be configured to force the outer peripheral edge 1440 circumferentially outwardly in the direction of the interior walls of the cup. As illustrated in FIG. 25F, the outermost portion 1448 of the anti-splash device 1410 can be shaped so as to form an angle 1470 relative to vertical. In some embodiments, this angle can be selected to match or approximate the draft angle of a cup into which the anti-splash device 1410 may be placed. For example, in one embodiment, the angle 1470 is approximately 2 to 20 degrees (e.g., 5, 10, 15 degrees, etc.). However, in other arrangements, the angle 1470 is greater than 20 degrees or less than 2 degrees, as desired or required by a particular application or use. In still other embodiments, the angle 1470 need not match the orientation, size or any other characteristic of a cup's draft angle.

In some arrangements, the outermost portion 1448 of an anti-splash device 1410 does not include a generally flat or uniform surface. For example, the outermost portion 1448 can be ruffled, rippled, textured, fluted, accordion-shaped and/or differently configured. In yet other embodiments, an anti-splash device can include two or more U or V-shaped channels along its peripheral edge. In still other arrangements, one or more other types of deformable features can be included, either in lieu of or in addition to the various embodiments of the peripheral edge described and illustrated herein. For example, an anti-splash device can include a soft, malleable or otherwise deformable resilient material (e.g., rubber, soft plastic, etc.) that does not comprise a channel or other compressible space.

In use, the anti-splash device 1410 can be lowered into the interior of a cup by a user. According to some embodiments, a user can grasp the device 1410 using a handle 1460, an opening 1226 (FIG. 23A) and/or any other member or feature. In some embodiments, the anti-splash device is configured to engage the interior walls of the cup at, near and/or just below the brim of the cup. By urging the anti-splash device 1410 deeper into the cup, the user can cause the outer peripheral edge 1440 to compress (e.g., move inwardly) so as to snugly secure the device 1410 within the interior walls of the cup and/or to form an enhanced seal between the device 1410 and the interior walls of the cup. As discussed, this can help prevent undesirable dislodging of the anti-splash device 1410 relative to the cup during use. Further, such a relatively tight fit can help reduce the amount of heat loss that occurs across the anti-splash device. According to some embodiments, urging the anti-splash device 1410 into the interior of a cup increases the contact area between the interior walls of the cup and the outermost portion 1448 of the device 1410. In some embodiments, the outermost portion 1448 of the anti-splash device 1410 can generally conform to the shape, draft angle and/or other characteristics of the interior of the cup. Consequently, at least a section of the outermost portion 1448 of the anti-splash device 1410 can contact and have substantially the same draft angle as the interior wall of the cup.

In addition, a user can remove or reposition (e.g., move upwardly or downwardly, tilt or change the angle relative to horizontal, etc.) the anti-splash device using the handle 1460 or some other feature. Once the anti-splash device 1410 is properly secured within a cup, a lid or other closure member can be optionally attached to the brim of the cup. The anti-splash device can be disposable or reusable, as desired or required by a particular application. For example, the anti-splash devices 1410 can be manufactured as single use items (e.g., thermoformed from polystyrene or one or more other thermoplastic materials). If the anti-splash device comprises more durable and expensive materials (e.g., stainless steel, other metals), the anti-splash device can be removed and reused.

With further reference to FIGS. 25A through 25F, the anti-splash device 1410 can be sized, shaped and otherwise configured to be secured at, near or below the brim of a cup. In embodiments where the anti-splash device 1410 is configured to be situated at or near the brim of a cup, the anti-splash device 1410 can provide certain additional benefits. For example, the anti-splash device 1410 can enhance the structural integrity of the upper portion of the cup, as the cup may be less likely to deform, collapse or otherwise change shape as a result of internal and/or external forces (e.g., grasping force by a user handling the cup, impact force by some object contacting an exterior portion of the cup, etc.). This can help ensure that the beverage or other contents of the cup are not accidentally spilled or compromised. In addition, such a configuration can help ensure that the lid or other closure member remains securely attached to the cup during use.

In addition, as discussed, having an anti-splash device 1410 positioned at, near or just below the brim of the cup can help ensure that a beverage does not leak at the interface between the brim of the cup and lid. Certain popular cup designs include a seam (e.g., vertical overlapping seam in a paper disposable coffee cup) or other similar feature that exists as part of the manufacturing process. The anti-splash device 1410 can help seal the seam near the brim of the cup where the cup would otherwise forms a generally poor seal with an adjacent lid or other closure device. Consequently, undesirable leaks can be reduced or prevented.

It will be appreciated that the outer peripheral edge 1440 as discussed with reference to the embodiment illustrated in FIGS. 25A through 25F can be included in any other embodiment of an anti-splash device described and/or illustrated herein, or a variation thereof.

Figure 26:
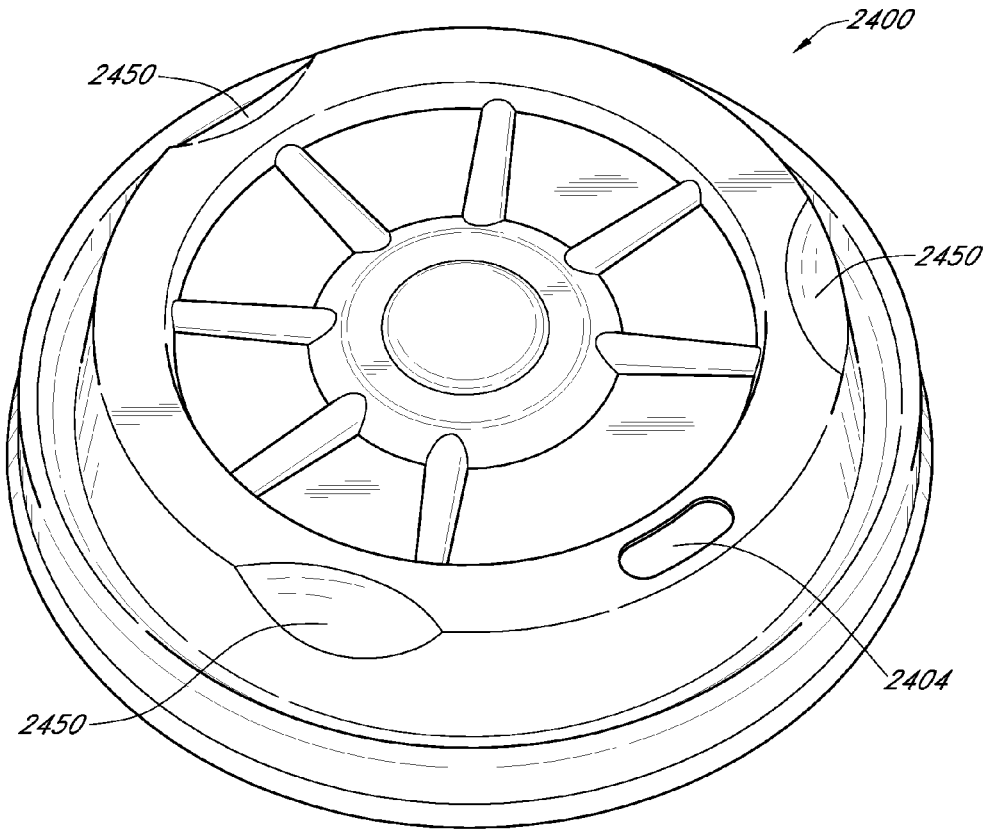
FIG. 26 is a top perspective view of a cup lid comprising a plurality of finger guides according to one embodiment.
Figure 27:
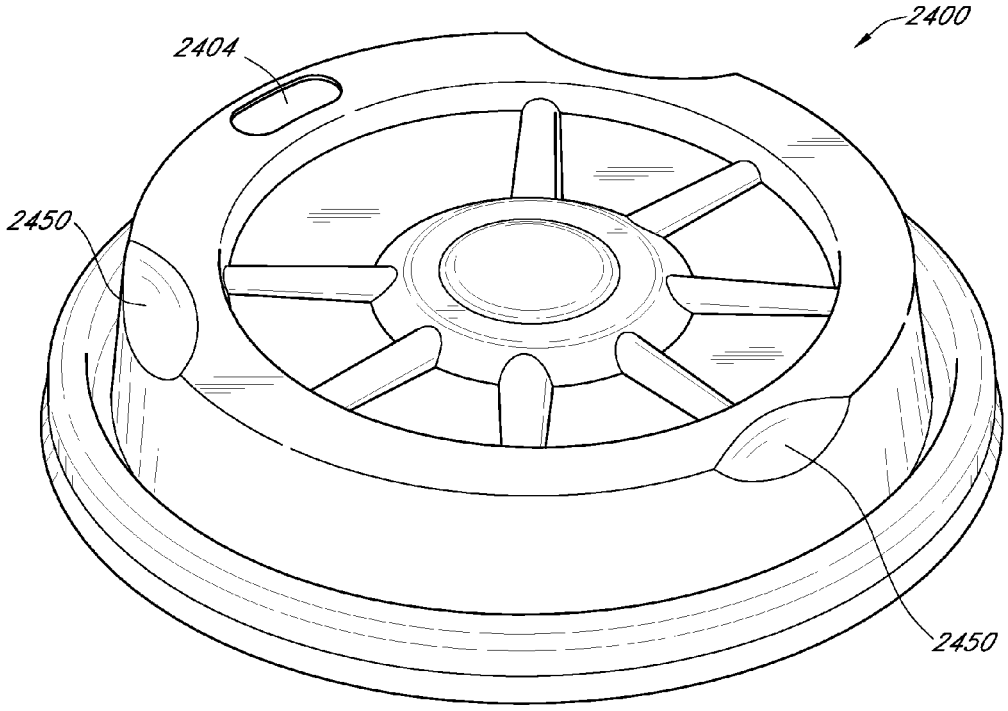
FIG. 27 is a different perspective view of the cup lid of FIG. 26.

FIGS. 26 and 27 illustrate a cup lid 2400 having a plurality of finger guides 2450 positioned on or near its top surface. As shown, the lid 2400 comprises a total of three finger guides 2450, spaced approximately 120 degrees from each other. As discussed herein with respect to the anti-splash device illustrated in FIG. 24, the quantity, size, spacing, location, shape, dimensions, materials of construction and/or any other characteristics or properties of the finger guides 2450 can vary as desired or required by a particular application or use.

With continued reference to the lid illustrated in FIGS. 26 and 27, the finger guides 2450 can be positioned near the outer edge of the tops surface of the lid 2400. However, as discussed, the finger guides 2450 can be positioned in different locations, can have a different size or shape and/or can be configured differently in other embodiments. The finger guides 2450 depicted in FIGS. 26 and 27 are angled relative to the top surface of the lid 2400, as well as relative to the side, cylindrical surface of the lid 2400. In some embodiments, the angle relative to adjacent surfaces can vary between 0 and 90 degrees. In addition, the finger guides 2450 can be textured and/or have one or more other features that help a user determine that the lid should be contacted and/or handled at the finger guides 2450.

The surface of the finger guides 1350, 2450 can be planar or non-planar. For example, in some embodiments, the finger guides can be convex or concave, to enhance the feel to a user's fingers. As discussed, the finger guide surfaces can be textured or smooth.

In use, an anti-splash device and/or a lid is contacted, handled and/or pushed relative to a cup using the finger guides. For example, an anti-splash device can be pushed into a lid, into a cup and/or any other location by pushing along its finger guides. Likewise, a cup lid can be snapped onto the brim of a cup by exerting a pushing force on the finger guides. Thus, the finger guides 1350, 2450 provide a preferred point of contact for a user of such devices. Consequently, the structural integrity of the device being pushed can be maintained. In addition, the finger guides provide certain hygienic advantages, as the risk of contamination resulting from contact with other portions of such devices can be advantageously reduced or eliminated.

Figure 28:
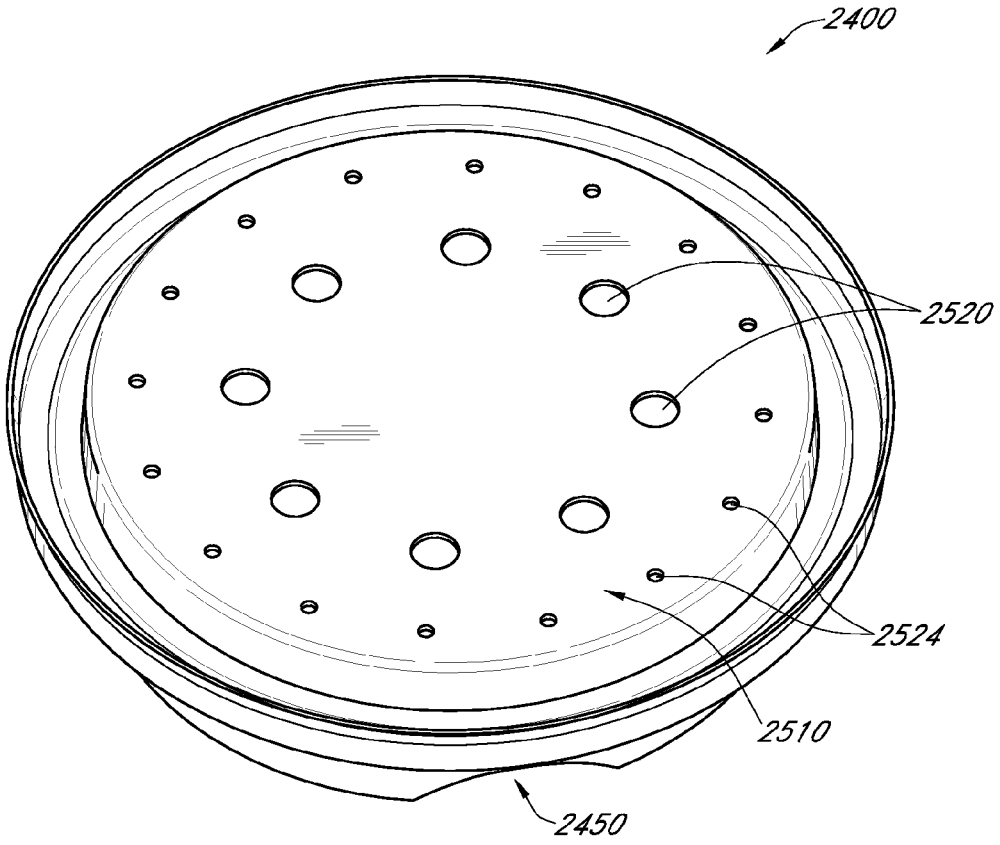
FIG. 28 is a bottom perspective view of an anti-splash device secured within the recessed area of a cup lid, which includes a plurality of finger guides according to one embodiment.

FIG. 28 illustrates a cup lid 2400 configured to receive an anti-splash device 2510 within its recessed area. This is similar to the embodiment illustrated in FIG. 21C. The cup lid 2400 includes one or more finger guides 2450 as discussed above. In some embodiments, the anti-splash device 2510 can include one or more finger guides (not shown), either in lieu of or in addition to the finger guides 2450 of the lid 2400. Therefore, when the anti-splash device 2510 and the lid 2400 are pushed relative to each other to engage the anti-splash device 2510 within an intended portion of the lid 2400, a user can advantageously handle the lid 2400 and/or the anti-splash device 2510 at the finger guides.

As discussed, any of the embodiments of the anti-splash device described herein and illustrated in FIGS. 1A through 28 can comprise a planar or non-planar shape. For example, the shape of an anti-splash device can be planar, non-planar, curved (e.g., convex, concave), domed, spherical, conical, fluted, wavy, curled, grooved, channeled, irregular-shaped and/or the like. In addition, such embodiments can comprise features and/or characteristics described and/or illustrated in one or more other embodiments.

Further, some of the embodiments of an anti-splash device disclosed herein, such as, for example, those illustrated in FIGS. 1A-2, 5, 6, 8A-9B, 16B, 17A-20B, 22A-22F, other embodiments disclosed herein, variations thereof, etc., are configured to be used either as independent members which are not attached to a lid or as members that can be incorporated into or otherwise attached to a lid or other closure device. For example, as discussed and illustrated herein, in embodiments where such anti-splash devices are separate from the lid or other closure member, the anti-splash devices can be configured to be free-floating within a cup interior. In other embodiments, such devices can be configured to secure to, engage, contact and/or otherwise interact with one or more portions of a cup (e.g., interior walls of the cup). Devices that are not configured to contact, attach to or be associated with a lid, other closure member or the like can be stand-alone devices, free-floating devices or members, free standing devices or members, unattached devices or members, independent devices or members, free devices or members, disconnected devices or members, disengaged devices or members, separated devices or members, interior devices or members and/or the like.

Alternatively, any of the embodiments of the anti-splash devices described and illustrated herein can be modified or otherwise adapted to be included as part of a lid, other closure member and/or another portion of the cup system. Such devices can be incorporated devices, members or lids, engaged devices, members or lids, dependent devices, members or lids, tandem devices, members or lids, joined devices, members or lids, unitary devices, members or lids, combination devices, members or lids and/or the like.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An anti-splash device configured for placement within a beverage container, the anti-splash device comprising:

a main body portion comprising a planar surface having a plurality of openings, the openings configured to permit the passage of fluids therethrough, a plurality of ribs extending from at least a portion of the planar surface; and an outer peripheral edge extending outwardly from the main body portion, the outer peripheral edge being configured to contact an interior wall of the container so as to generally securely maintain a position of the anti-splash device relative to the container;

wherein the main body portion is configured to be located below a brim of the container and when situated therein;

wherein the outer peripheral edge comprises an upwardly opening U-shaped or V-shaped channel, said U-shaped or V-shaped channel being configured to deform as the anti-splash device is placed into engaging contact with an interior of the beverage container;

wherein the U-shaped or V-shaped channel is substantially disposed below the planar surface;

wherein the anti-splash device is located completely within an interior of the container when securely positioned therein;

wherein at least a section of the outer peripheral edge is configured to generally conform to the shape of and be generally parallel to an internal wall of the beverage container into which the anti-splash device is secured; and wherein the U-shaped or V-shaped channel becomes compressed while a shape of the main body portion remains the same when anti-splash device is urged deeper into a beverage container.

2. The anti-splash device of claim 1, wherein at least one of the openings defines a substantially circular shape.

3. The anti-splash device of claim 1, wherein at least some of the openings are arranged in a generally circular pattern.

4. The anti-splash device of claim 1, wherein the main body portion comprises a grasping member, the grasping member being configured to permit a user to selectively manipulate the anti-splash device.

5. The anti-splash device of claim 1, wherein the main body portion comprises an orifice, the orifice being configured to permit a user to selectively manipulate the anti-splash device.

6. The anti-splash device of claim 1, wherein at least one of the main body portion and the outer peripheral edge is connected to a container lid or other closure member.

7. The anti-splash device of claim 1, wherein the plurality of ribs are integrally-formed on the main body portion, each of said ribs comprising a raised portion along a first side of the main body portion and a corresponding groove or recess along a second, opposite side of the main body portion, said ribs generally improving stability and flow channeling characteristics of the anti-splash device positioned within a beverage container.

8. The anti-splash device of claim 1, wherein the planar surface is generally horizontal when properly secured within a beverage container.

9. The anti-splash device of claim 1, wherein the main body portion of the anti-splash device comprises an upper surface and a lower surface, wherein fluids passing through the plurality of openings move directly from the lower surface to the upper surface.

10. The anti-splash device of claim 1, wherein the plurality of ribs are integrally formed within the main body portion.

11. The anti-splash device of claim 1, wherein the plurality of ribs are molded, cast, thermoformed or stamped along the main body portion.

12. The anti-splash device of claim 1, wherein the main body portion and the outer peripheral edge are a unitary member.

13. The anti-splash device of claim 12, wherein the main body portion and the outer peripheral edge comprise a thermoplastic material.

14. An anti-splash device configured for placement within a beverage container, comprising:

a main body portion comprising a planar surface having a plurality of openings, the openings configured to permit the passage of fluids therethrough, the main body portion comprising a plurality of ribs that extend from at least a portion of the planar surface; and an upwardly opening deformable peripheral channel extending outwardly from the main body portion, the deformable peripheral channel comprising an outermost portion that defines, at least in part, an interior space of the deformable peripheral channel, said outermost portion being configured to contact an interior wall of a beverage container so as to securely maintain the position of the anti-splash device relative to the beverage container;

wherein the main body portion is located below a brim of the beverage container when situated therein;

wherein the interior space comprises a first lateral size when the deformable peripheral channel is in an uncompressed state;

the interior space of the deformable peripheral channel comprises a second lateral size when the anti-splash device is positioned within the beverage container and when the outermost portion contacts and is compressed by the interior wall of the beverage container, wherein the first lateral size is greater than the second lateral size;

wherein the anti-splash device is located completely within an interior of the beverage container when securely positioned therein;

the outermost portion of the deformable peripheral channel is substantially disposed below the main body portion; and the outermost portion of the deformable peripheral channel having a flexibility so that said outermost portion generally conforms to a draft angle of the interior wall of the beverage container when the anti-splash device is urged within the beverage container.

15. The anti-splash device of claim 14, wherein the deformable peripheral channel is generally U-shaped or V-shaped.

16. The anti-splash device of claim 14, wherein the plurality of ribs are integrally-formed on the main body portion, each of the ribs comprising a raised portion along a first side of the main body portion and a corresponding recess along a second, opposite side of the main body portion.

17. The anti-splash device of claim 14, wherein the plurality of ribs are integrally formed within the main body portion.

18. The anti-splash device of claim 14, wherein the plurality of ribs are molded, cast, thermoformed or stamped along the main body portion.

* * * * *